US007961170B2

(12) United States Patent
Lim

(10) Patent No.: US 7,961,170 B2
(45) Date of Patent: Jun. 14, 2011

(54) DRIVE CIRCUIT OF DISPLAY DEVICE AND METHOD FOR DRIVING THE DISPLAY DEVICE

(75) Inventor: Kyoung Moon Lim, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 12/889,048

(22) Filed: Sep. 23, 2010

(65) Prior Publication Data

US 2011/0012940 A1 Jan. 20, 2011

Related U.S. Application Data

(62) Division of application No. 11/602,338, filed on Nov. 21, 2006, now Pat. No. 7,821,486.

(30) Foreign Application Priority Data

Apr. 13, 2006 (KR) ..... 2006-0033675

(51) Int. Cl.
*G09G 3/36* (2006.01)
*G09G 5/00* (2006.01)

(52) U.S. Cl. ..... 345/100; 345/96

(58) Field of Classification Search ..... 345/96, 345/100

See application file for complete search history.

(56) References Cited

U.S. PATENT DOCUMENTS

| | | | | |
|---|---|---|---|---|
| 2002/0047822 | A1 * | 4/2002 | Senda et al. | 345/90 |
| 2002/0063674 | A1 | 5/2002 | Chiang | |
| 2003/0090481 | A1 | 5/2003 | Kimura | |
| 2004/0179027 | A1 | 9/2004 | Nakai et al. | |
| 2004/0263466 | A1 | 12/2004 | Song et al. | |
| 2005/0264548 | A1 * | 12/2005 | Okamura et al. | 345/204 |
| 2006/0146001 | A1 | 7/2006 | Minami | |
| 2008/0170027 | A1 | 7/2008 | Kyeong et al. | |

FOREIGN PATENT DOCUMENTS

| | | |
|---|---|---|
| JP | 05-150216 | 6/1993 |
| JP | 06-075543 | 3/1994 |
| JP | 07-191631 | 7/1995 |
| JP | 09-319340 | 12/1997 |
| JP | 2002-132221 | 5/2002 |
| JP | 2004-061782 | 2/2004 |

* cited by examiner

*Primary Examiner* — Alexander S Beck
*Assistant Examiner* — Jonathan Boyd
(74) *Attorney, Agent, or Firm* — McKenna Long & Aldridge LLP

(57) ABSTRACT

A drive circuit of a display device and a method for driving the display device are disclosed. The drive circuit includes at least one data transfer line to receive analog data signals including information for an image; a first latch to sequentially sample analog data signals transferred from the at least one data transfer line and to sequentially store the sampled analog data signals; and a second latch to receive the sampled analog data signals from the first latch and to simultaneously supply the sampled analog data signals to a display.

15 Claims, 12 Drawing Sheets

FIG. 12A

| R | G | B | R | G | B | · · · · | G | B |
|---|---|---|---|---|---|---|---|---|
| + | - | + | - | + | - | · · · · | + | - |
| + | - | + | - | + | - | · · · · | + | - |
| + | - | + | - | + | - | · · · · | + | - |
| + | - | + | - | + | - | · · · · | + | - |
| + | - | + | - | + | - | · · · · | + | - |
| ⋮ | ⋮ | ⋮ | ⋮ | ⋮ | ⋮ | ⋱ | ⋮ | ⋮ |
| + | - | + | - | + | - | · · · · | + | - |

FIG. 12B

| R | G | B | R | G | B | · · · · | G | B |
|---|---|---|---|---|---|---|---|---|
| - | + | - | + | - | + | · · · · | - | + |
| - | + | - | + | - | + | · · · · | - | + |
| - | + | - | + | - | + | · · · · | - | + |
| - | + | - | + | - | + | · · · · | - | + |
| - | + | - | + | - | + | · · · · | - | + |
| ⋮ | ⋮ | ⋮ | ⋮ | ⋮ | ⋮ | ⋱ | ⋮ | ⋮ |

DRIVE CIRCUIT OF DISPLAY DEVICE AND METHOD FOR DRIVING THE DISPLAY DEVICE

Cross-Reference To Related Applications

This application is a Divisional of application Ser. No. 11/602,338 filed Nov. 21 , 2006 now U.S. Pat. No. 7,821,486, now allowed, which claims priority to Korean Patent Application No. 10-2006-0033675, filed Apr. 13, 2006, all of which are hereby incorporated by reference for all purposes as if fully set forth herein.

BACKGROUND OF THE INVENTION

1. Field of the Invention

The present invention relates to a display device, and more particularly, to a drive circuit of a display device and a method for driving the display device.

2. Discussion of the Related Art

Recently, various flat display devices have been developed that can eliminate the bulky and heavy structures associated with cathode ray tube based displays. These flat panel display devices include liquid crystal displays, field emission displays, plasma display panels, and light emitting diode based displays.

Typically, a liquid crystal display includes a thin film transistor substrate, a color filter substrate separated by a uniform distance from the thin film transistor substrate, and a liquid crystal layer formed between the substrates. A plurality of liquid crystal cells are arranged in regions defined by the crossings of an associated one of a plurality of data lines and an associated one of a plurality of gate lines. A thin film transistor, which is a switch element, is formed at each liquid crystal cell. In a liquid crystal display having the above-described structure, an electric field is generated at each liquid crystal cell in accordance with a data signal to adjust the transmittance of light through the liquid crystal layer. By controlling the transmittance of light through the liquid crystal layer, a desired image is displayed on the liquid crystal display.

Hereinafter, a liquid crystal display of the related art will be described with reference to the FIGS. 1 and 2 of the accompanying drawings.

FIG. 1 is a circuit diagram illustrating a drive circuit used in a liquid crystal display of the related art. FIG. 2 is a timing diagram of sampling scan pulses output from the shift register of the drive circuit shown in FIG. 1.

As shown in FIG. 1, the drive circuit of the liquid crystal display of the related art includes a shift register SR for sequentially outputting sampling scan pulses SP1 to SPm, a data transfer line DT for transferring an analog data signal Data having information as to an image, and a switch unit 10 for sampling the analog data signal Data from the data transfer line DT in response to a sampling scan pulse output from the shift register SR, and outputting the sampled signal.

The switch unit 10 includes a plurality of switches SW1 to SWm. Each of the switches SW1 to SWm is a 3-terminal switch. That is, each of the switches SW1 to SWm has a first terminal connected to the shift register SR to control the switch, a second terminal connected to the data transfer line DT, and a third terminal connected to an associated data line DL1 to DLm of the display.

The switches SW1 to SWm are sequentially turned on in response to the first to m-th scan pulses SP1 to SPm sequentially supplied from the shift register SR, respectively. That is, the first to m-th sampling scan pulses SP1 to SPm are sequentially supplied to the first to m-th switches SW1 to SWm, respectively, and as a result, the first to m-th switches SW1 to SWm are sequentially turned on. Further, when one of the switches SW1 to SWm is in an ON state, the remaining ones of the switches SW1 to SWm are maintained in an OFF state.

When in an ON state, each of the switches SW1 to SWm samples the analog data signal data supplied to the data transfer line DT, and supplies the sampled signal to the associated data line. Thus, sampled analog data signals are supplied to the data lines DL1 to DLm of the display in a sequential manner. Analog data signals associated with one horizontal line are supplied to the data lines DL1 to DLm in a sequential manner within one horizontal period 1H.

The sampled analog data signals respectively supplied to the data lines DL1 to DLm are then supplied to a plurality of pixel cells connected in common to one gate line in a sequential manner, respectively. A gate signal GS is supplied to the gate line, in order to sustain the gate line in a high-level state for one horizontal period.

Although not shown, each pixel cell includes a thin film transistor connected between an associated one of the gate lines and an associated one of the data lines, and a pixel electrode connected to the thin film transistor.

The thin film transistor of each pixel cell is turned on in response to a high-level gate signal GS from the associated gate line. In an ON state thereof, the thin film transistor supplies the sampled analog data signal from the associated data line to the pixel electrode of the associated pixel cell.

Because the first switch SW1 is the first of the switches to be turned on during a horizontal period, the first-sampled analog data signal is supplied to the first data line DL1. As a result, the sampled analog data signal is applied to the first pixel cell for a period (i.e. a data sustain time) longer than the period of application to pixel cells via the remaining switches. That is, the thin film transistor of the first pixel cell is maintained in an ON state for nearly a complete horizontal period after the point of time when the first pixel cell receives the sampled analog signal. Accordingly, the data sustain time of the first pixel cell of a horizontal line is longer than that for the remaining pixel cells in the horizontal line.

On the other hand, the last-sampled analog data signal is supplied latest to the m-th data line DLm because the m-th switch SWm is the last to be turned on. As a result, the m-th pixel cell connected to the m-th data line DLm sustains the sampled analog data signal for the shortest period of all of the pixel cells in a horizontal line. That is, the thin film transistor of the m-th pixel cell is maintained in an ON state for a relatively short time after the point of time when the m-th pixel cell receives the sampled analog signal. Accordingly, the data sustain time of the m-th pixel cell is shortest.

The variation in data sustain times may result in a brightness difference among the pixel cells of the display and degradation of the picture quality of the display.

SUMMARY OF THE INVENTION

Accordingly, the present invention is directed to a drive circuit of a display device and a method for driving the display device that substantially obviate one or more problems due to limitations and disadvantages of the related art.

An advantage of the present invention is to provide a drive circuit of a display device and a method for driving the display device in which sampled analog data signals are simultaneously supplied to respective data lines of a display, thereby achieving a reduction in the brightness difference among pixel cells.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a drive circuit of a display device includes: at least one data transfer line to receive analog data signals including information for an image; a first latch to sequentially sample analog data signals transferred from the at least one data transfer line and to sequentially store the sampled analog data signals; and a second latch to receive the sampled analog data signals from the first latch and to simultaneously supply the sampled analog data signals to a display In another aspect of the present invention, a drive circuit of a display device includes: at least one data transfer line to receive analog data signals having information for an image; a first positive latch to sequentially sample positive and negative analog data signals received by the at least one data transfer line and to sequentially store the sampled positive and negative analog data signals; a second positive latch to simultaneously output the positive and negative analog data signals sampled by the first positive latch; a first negative latch to sequentially sample the positive and negative analog data signals received by the at least one data transfer line and to sequentially store the sampled positive and negative analog data signals; a second negative latch to simultaneously output the positive and negative analog data signals sampled by the first negative latch; and a selector to select the positive ones of the sampled positive and negative analog data signals output from the second positive latch and to select the negative ones of the sampled positive and negative analog data signals output from the second negative latch, and to simultaneously supply the selected positive and negative analog signals to a display In still another aspect of the present invention, a method for driving a display device includes: outputting analog data signals having information for an image; sequentially sampling the analog data signals, and sequentially storing the sampled analog data signals; and simultaneously supplying the sampled analog data signals to a display.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 12A is a schematic diagram illustrating a polarity pattern of the display device in an odd frame period; and FIG. 12B is a schematic diagram illustrating a polarity pattern of the display device in an even frame period.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
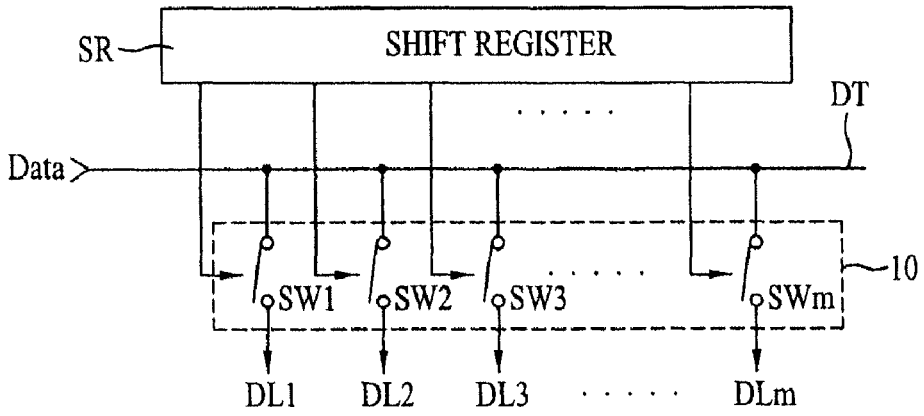
FIG. 1 Related Art
FIG. 1 is a circuit diagram illustrating a drive circuit used in a liquid crystal display of the related art.
Figure 2:
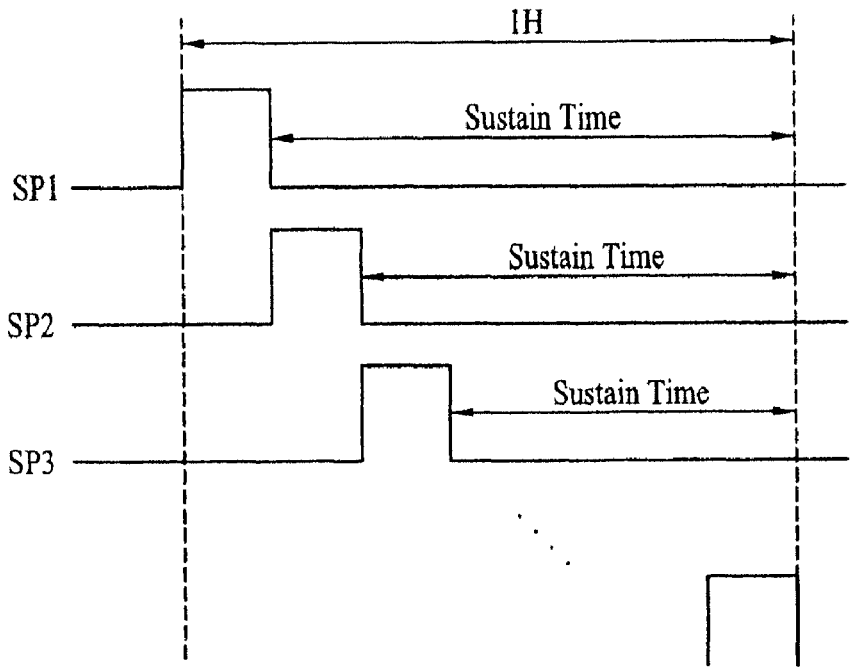
FIG. 2 Related Art
FIG. 2 is a timing diagram showing sampling scan pulses output from a shift register shown in FIG. 1.
Figure 3:
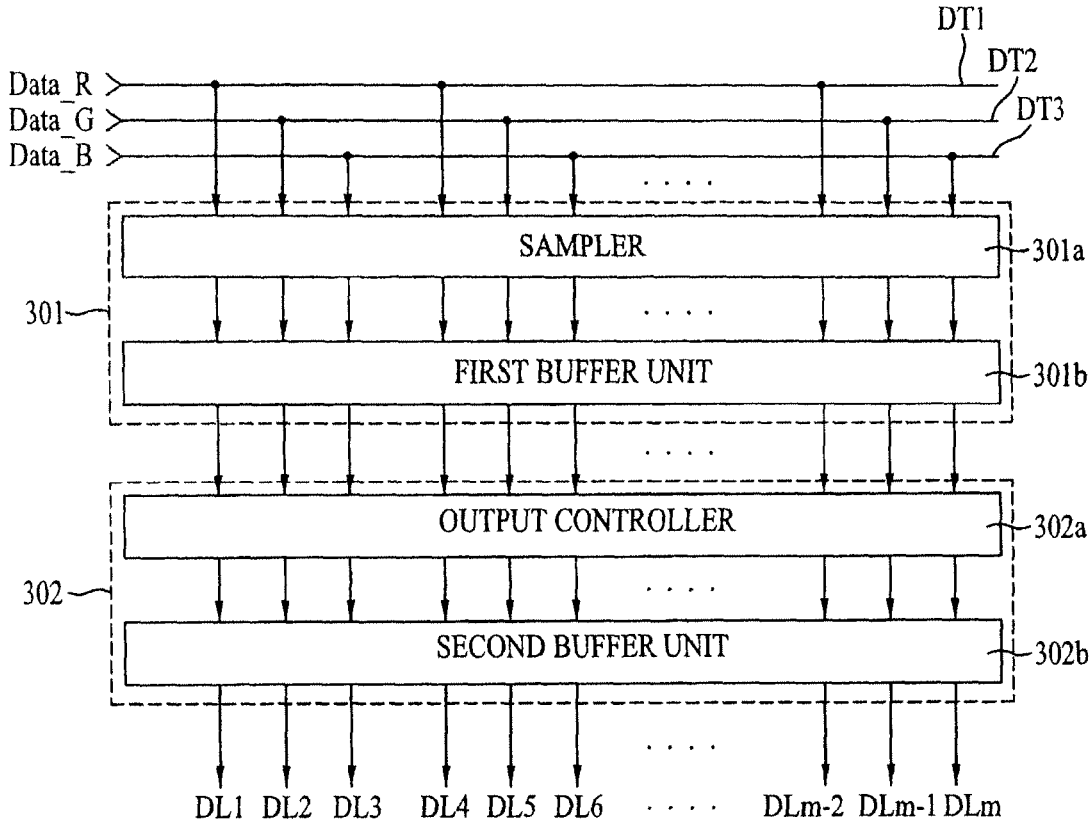
FIG. 3 is a circuit diagram illustrating a drive circuit of a display device according to a first embodiment of the present invention.

FIG. 3 is a circuit diagram illustrating a drive circuit of a display device according to a first embodiment of the present invention.

As shown in FIG. 3, the drive circuit of the display device according to the first embodiment of the present invention includes: first to third data transfer lines DT1 to DT3 for transferring analog data signals Data_R, Data_G, and Data_B having information as to an image, respectively; a first latch 301 for sequentially sampling the analog data signals Data_R, Data_G, and Data_B from the data transfer lines DT1 to DT3 and sequentially storing the sampled analog data signals; and a second latch 302 for receiving the sampled analog data signals from the first latch 301 and simultaneously supplying the received sampled analog data signals to a display.

The display includes a plurality of gate lines arranged in one direction, a plurality of data lines DL1 to DLm arranged in a direction substantially perpendicular to the gate lines, and pixel cells each formed in a pixel region defined by a crossing of an associated one of the gate lines and an associated one of the data lines DL1 to DLm. Each pixel cell is connected to the associated gate line and associated data line to display a unit image in accordance with an analog data signal supplied to the associated data line.

Each pixel cell includes: a thin film transistor which is turned on in response to a gate signal from the associated gate line to switch an analog data signal from the associated data line; a pixel electrode to receive the analog data signal from the thin film transistor in accordance with the switching operation of the thin film transistor; a common electrode facing the pixel electrode to receive a common voltage; and a liquid crystal layer formed between the common electrode and the pixel electrode. The light transmittance of the liquid crystal layer varies with the intensity of the electric field generated due to a voltage difference between the common electrode and the pixel electrode.

The first to third data transfer lines DT1 to DT3 function to transfer the analog data signals Data_R, Data_G, and Data_B supplied to the first latch 301 from a timing controller. The first data transfer line DT1 supplies the first analog data signal Data_R representing information as to an image to be displayed in association with red. The second data transfer line DT2 supplies the second analog data signal Data_G representing information as to the image to be displayed in association with green. The third data transfer line DT3 supplies the third analog data signal Data_B representing information as to an image to be displayed in association with blue.

In the first embodiment of the present invention, one or more data transfer lines may be used. When a single data transfer line is used, the first to third analog data signals Data_R, Data_G, and Data_B are sequentially supplied to the single data transfer line.

The first latch 301 includes: a sampler 301*a* for receiving the first to third data signals Data_R, Data_G, and Data_B from the first to third data transfer lines DT1 to DT3, and sequentially sampling the received data signals Data_R, Data_G, and Data_B; and a first buffer unit 301*b* for sequentially storing the sampled analog data signals output from the sampler 301*a*, and outputting the stored signals after buffering the stored signals.

The second latch 302 includes an output controller 302*a* for simultaneously outputting the sampled analog data signals stored in the first buffer unit 301*b* and a second buffer unit 302*b* for buffering the sampled analog data signal output from the output controller 302*a*, and supplying the buffered signals to the display.

Hereinafter, the configurations of the sampler 301*a*, first buffer unit 301*b*, output controller 302*a*, and second buffer unit 302*b* will be described in more detail.

Figure 4:
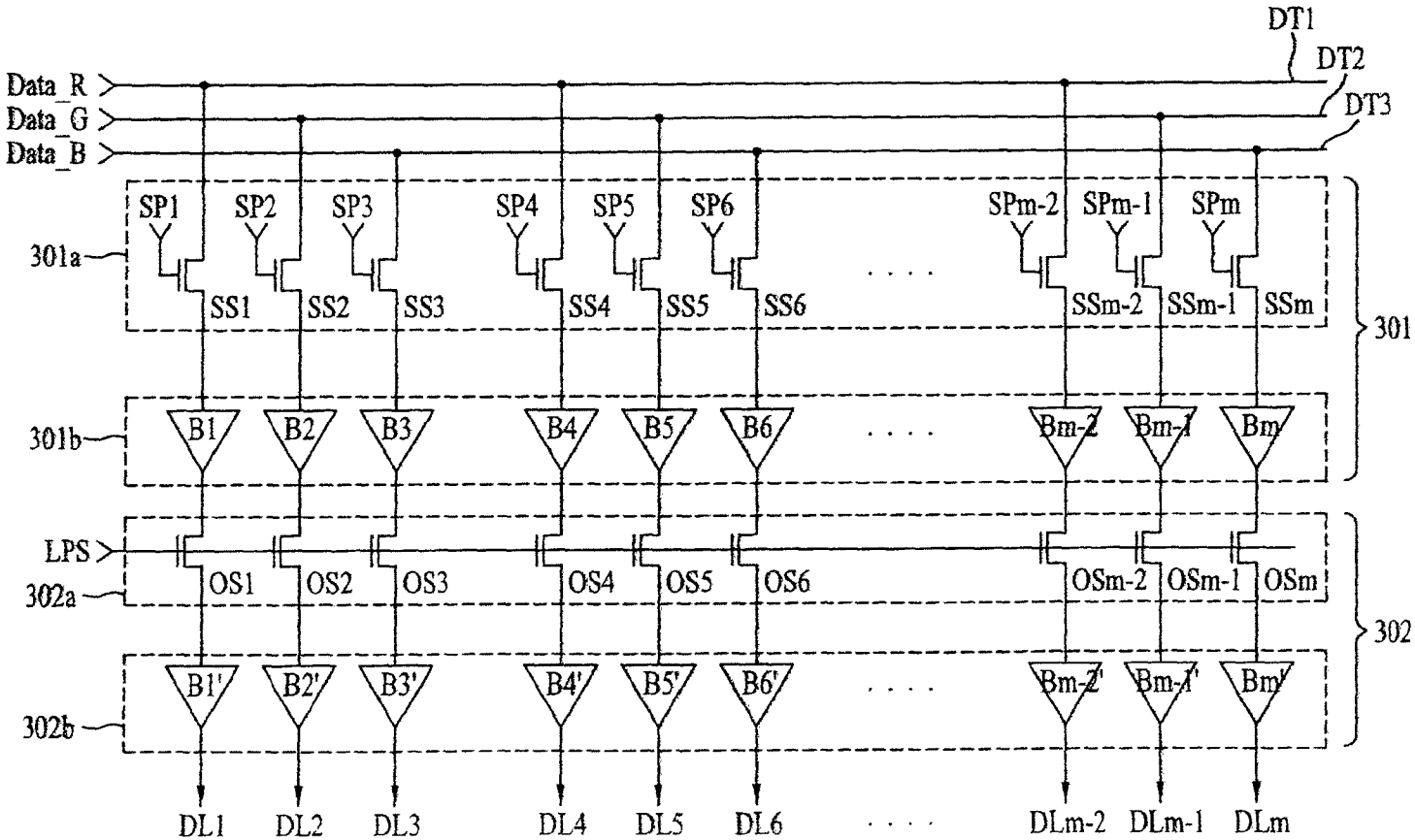
FIG. 4 is a circuit diagram illustrating configurations details of a sampler, a first buffer unit, an output controller, and a second buffer unit shown in FIG. 3.
Figure 5:
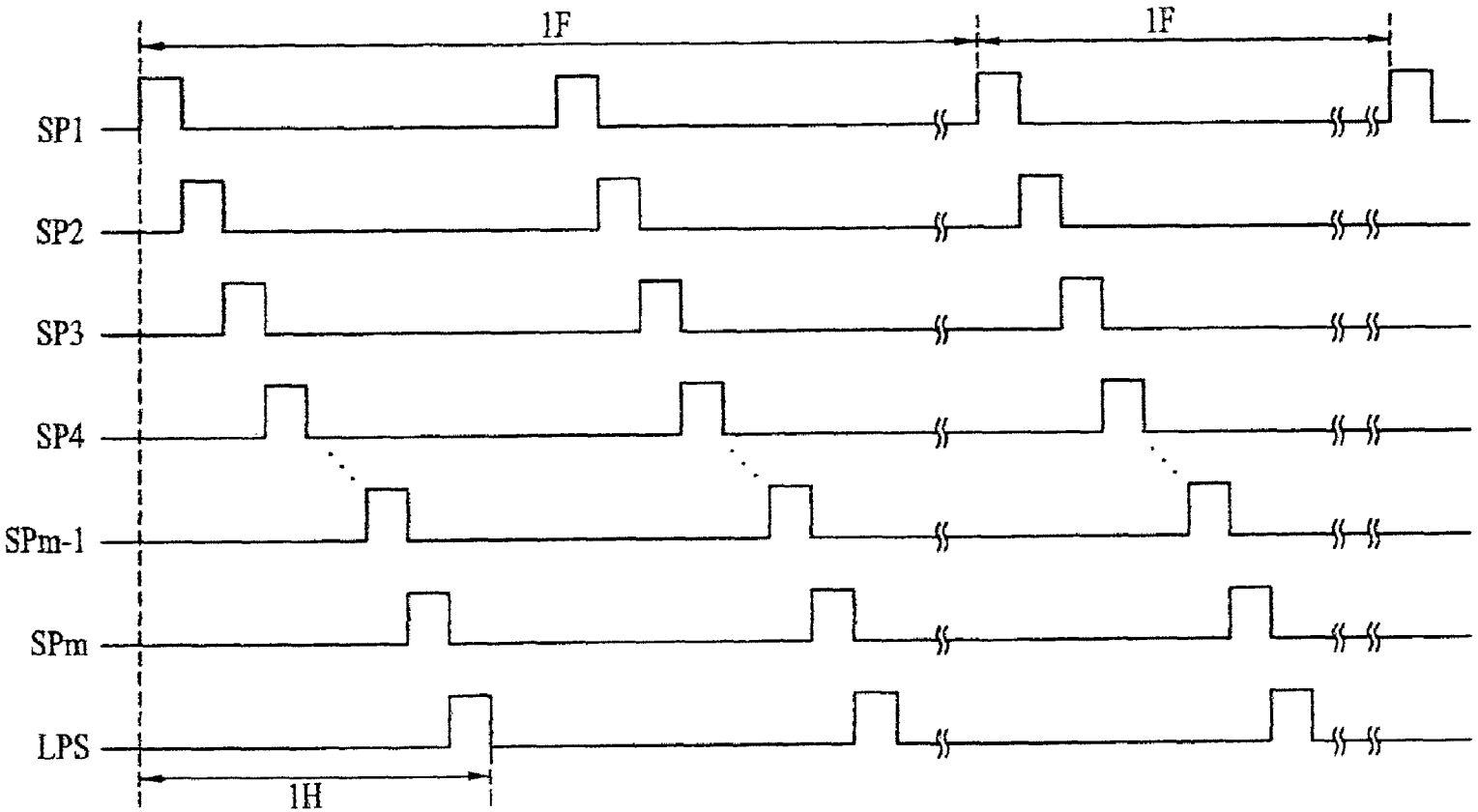
FIG. 5 is a timing diagram showing various signals supplied to the sampler and output controller shown in FIG. 4.

FIG. 4 is a circuit diagram illustrating configuration details of the sampler, first buffer unit, output controller, and second buffer unit shown in FIG. 3. FIG. 5 is a timing diagram illustrating various signals supplied to the sampler and output controller shown in FIG. 4.

As shown in FIG. 4, the sampler 301*a* includes a plurality of sampling switches SS1 to SSm. The first buffer unit 301*b* includes a plurality of buffers B1 to Bm. The output controller 302*a* includes a plurality of output switches OS1 to OSm. The second buffer unit 302*b* includes a plurality of buffers B1' to Bm'.

The sampling switches SS1 to SSm included in the sampler 301*a* are sequentially turned on during one horizontal period in response to first to m-th sampling scan pulses SP1 to SPm sequentially supplied from a shift register (not shown), respectively. That is, the first sampling switch SS1 is first turned on within one horizontal period in response to the first sampling scan pulse SP1. Next, the second sampling switch SS2 is turned on within the horizontal period in response to the second sampling scan pulse SP2. Next, the third sampling switch SS3 is turned on within the horizontal period in response to the third sampling scan pulse SP3. Finally, the m-th switch SSm is turned on within the horizontal period in response to the m-th sampling scan pulse SPm. When any one of the sampling switches SS1 to SSm is turned on, the remaining switches are maintained in an OFF state. The sampling switches SS1 to SSm may be implemented using thin film transistors having drain, gate, and source electrodes.

Each of the sampling switches SS1 to SSm includes a gate electrode connected to the shift register, a source electrode connected to an associated one of the first to third data transfer lines DT1 to DT3, and a drain electrode connected to an input terminal of an associated one of the buffers included in the first buffer unit 301*b*.

Each of the (3k+1)-th switches SS1, SS4, SS7, . . . , SSm-2 of the sampling switches SS1 to SSm function to sample the first analog data signal Data_R. Each of the (3k+2)-th switches SS2, SS5, SS8, . . . , SSm-1 of the sampling switches SS1 to SSm function to sample the second analog data signal Data_G. Each of the (3k+3)-th switches SS3, SS6, SS9, . . . , SSm of the sampling switches SS1 to SSm function to sample the third analog data signal Data_B. Here, "k" is a non-negative integer.

To this end, the sources of the (3k+1)-th switches SS1, SS4, SS7 . . . SSm-2 are connected in common to the first data transfer line DT1 which transfers the first analog data signal Data_R. Similarly, the sources of the (3k+2)-th switches SS2, SS5, SS8, . . . , SSm-1 are connected in common to the second data transfer line DT2 which transfers the second analog data signal Data_G. The sources of the (3k+3)-th switches SS3, SS6, SS9 . . . SSm are connected in common to the third data transfer line DT3 which transfers the third analog data signal Data_B.

Meanwhile, in order to prevent degradation of the liquid crystal layer included in the display, the pixel cell are driven in accordance with an inversion driving method in which a positive analog data signal and a negative analog data signal are alternately supplied to each pixel cell. Inversion driving methods such as a line inversion driving method, a column inversion driving method, a frame inversion driving method, and a dot inversion driving method may be used.

The line inversion driving method is a method in which analog data signals are supplied to the pixel cells such that the analog data signals supplied to the pixel cells arranged along an X-axis direction have the same polarity, whereas the analog data signals supplied to pixel cells adjacent along a Y-axis direction have opposite polarities.

The column inversion driving method is a method in which analog data signals are supplied to the pixel cells such that the analog data signals supplied to the pixel cells arranged along a Y-axis direction have the same polarity, whereas the analog data signals supplied to pixel cells adjacent along an X-axis direction have opposite polarities.

The frame inversion driving method is a method in which positive and negative analog data signals are alternately supplied to each pixel cell on a frame basis.

The dot inversion driving method is a method in which analog data signals having opposite polarities are applied to pixels adjacent in either the X-axis direction or the Y-axis direction.

The driving circuit of the display device according to the first embodiment of the present invention drives the display device in accordance with one of the above-described inversion driving methods.

To this end, each of the first to third analog data signals Data_R, Data_G, and Data_B has a polarity that varies between a positive polarity and a negative polarity at predetermined time intervals. A positive analog data signal means a signal having a voltage level higher than a common voltage, whereas a negative analog data signal means a signal having a voltage level lower than the common voltage.

In the circuit as illustrated in FIG. 4, adjacent ones of the data transfer lines transfer analog data signals having opposite polarities, respectively. Accordingly, adjacent ones of the sampling switches transfer analog data signals having opposite polarities, respectively.

On the other hand, when a single data transfer line is used, the first to third analog data signals Data_R, Data_G, and Data_B are sequentially supplied to the data transfer line. In this case, the analog data signals supplied in successive periods have opposite polarities.

The output switches OS1 to OSm included in the output controller 302*a* are simultaneously turned on in response to a line pass signal LPS externally supplied to the output controller 302*a* to simultaneously output the sampled analog data signals respectively stored in the buffers B1 to Bm of the first buffer unit 301*b*. The sampled analog data signals output from the output switches OS1 to OSm are simultaneously supplied to the buffers B1' to Bm' included in the second buffer unit 302*b*, respectively.

To this end, the gates of the output switches OS1 to OSm are connected in common to a transfer line which transfers the line pass signal LPS. In addition, the sources of the output switches OS1 to OSm are connected to respective output terminals of the associated buffers B1 to Bm of the first buffer unit 301*b*. The drains of the output switches OS1 to OSm are connected to respective input terminals of the associated buffers B1' to Bm' of the second buffer unit 302*b*.

The buffers B1' to Bm' of the second buffer unit 302*b* buffer the sampled analog data signals supplied via the output switches OS1 to OSm, respectively, and simultaneously supply the buffered signals to the data lines of the display, respectively.

A method for driving the display device using the drive circuit having the above-described configuration according to the first embodiment of the present invention will now be described in detail.

The timing controller controls the timing of the first to third analog data signals Data_R, Data_G, and Data_B, to enable the first to third analog data signals Data_R, Data_G, and Data_B to be supplied to the first to third data transfer lines DT1 to DT3, respectively. That is, in accordance with the timing control operation of the timing controller, the first analog data signal Data_R is supplied to the first data transfer line DT1. In addition, the second and third analog data signals Data_G and Data_B are supplied to the second and third data transfer lines DT2 and DT3, respectively.

In sync with the timing of the first to third analog data signals Data_R, Data_G, and Data_B, the shift register sequentially supplies the sampling scan pulses SP1 to SPm to respective sampling switches SS1 to SSm.

That is, the shift register sequentially outputs the first to m-th sampling scan pulses SP1 to SPm for every horizontal period. The output first to m-th sampling scan pulses SP1 to SPm are sequentially supplied to the first to m-th sampling switches SS1 to SSm, thereby sequentially turning on the first to m-th sampling switches SS1 to SSm within one horizontal period, respectively.

Each of the sampling switches SS1 to SSm when turned on samples the analog data signal supplied from the associated data transfer line to which the sampling switch is connected.

In particular, the first sampling switch SS1, fourth sampling switch SS4, seventh sampling switch SS7, . . . and the (m-2)-th sampling switch SSm-2 connected to the first data transfer line DT1 sample the first analog data signal Data_R supplied from the first data transfer line DT1. That is, the (3k+1)-th sampling switches SS1, SS4, SS7 . . . SSm-2 sample the first analog data signal Data_R.

Assuming for the purpose of example that the drive circuit of the display device performs column inversion driving, the first analog data signal Data_R has a polarity alternately varying between positive and negative polarities.

The first analog data signal Data_R having a positive polarity, is supplied to the first data transfer line DT1 during times when the (6k+1)-th ones of the (3k+1)-th sampling switches SS1, SS4, SS7, . . . , SSm-2, namely, the sampling switches SS1, SS7, SS13 . . . , SSm-5, are turned on. On the other hand, the first analog data signal Data_R having a negative polarity, is supplied to the first data transfer line DT1 during times when the (6k+4)-th sampling switches SS4, SS10, SS16 . . . , SSm-2 are turned on, respectively.

The second sampling switch SS2, fifth sampling switch SS5, eighth sampling switch SS8 . . . , and (m-1)-th sampling switch SSm-1 connected to the second data transfer line DT2 sample the second analog data signal Data_G supplied from the second data transfer line DT2. That is, the (3k+2)-th sampling switches SS2, SS5, SS8 . . . , SSm-1 sample the second analog data signal Data_G.

Similarly to the first analog data signal Data_R, the second analog data signal Data_G has a polarity alternately varying between positive and negative polarities.

The second analog data signal Data_G having a positive polarity, is supplied to the second data transfer line DT2 during times when the (6k+2)-th ones of the (3k+2)-th sampling switches SS2, SS5, SS8, . . . , SSm-1, namely, the sampling switches SS2, SS8, SS14, . . . , SSm-4, are turned on, respectively. On the other hand, the second analog data signal Data_G having a negative polarity, is supplied to the second data transfer line DT2 during times when the (6k+5)-th sampling switches SS5, SS11, SS17, . . . , SSm-1 are turned on, respectively.

The third sampling switch SS3, sixth sampling switch SS6, ninth sampling switch SS9 . . . , and m-th sampling switch SSm connected to the third data transfer line DT3 sample the third analog data signal Data_B supplied from the third data transfer line DT3. That is, the (k+3)-th sampling switches SS3, SS6, SS9 . . . , SSm sample the third analog data signal Data_B.

Similarly to the first analog data signal Data_R, the third analog data signal Data_B has a polarity alternately varying between positive and negative polarities.

The third analog data signal Data_B, which has a positive polarity, is supplied to the third data transfer line DT3 during times when the (6k+3)-th ones of the (3k+3)-th sampling switches SS3, SS6, SS9, . . . , SSm, namely, the sampling switches SS3, SS9, SS15, . . . , SSm-3, are turned on, respectively. On the other hand, the third analog data signal Data_B, which has a negative polarity, is supplied to the third data transfer line DT3 during times when the (6k+6)-th sampling switches SS6, SS12, SS18, . . . , SSm are turned on, respectively.

As a result, adjacent sampling switches sample analog data signals having different polarities.

That is, the odd sampling switches SS1, SS3 . . . , SSm-1 sample an analog data signal having a positive polarity, whereas the even sampling switches SS2, SS4 . . . , SSm sample an analog data signal having a negative polarity.

The analog data signals sequentially sampled by the sampling switches SS1 to SSm are sequentially supplied to and stored in the buffers B1 to Bm included in the first buffer unit 301*b*.

That is, the first analog data signal sampled by the first sampling switch SS1 is stored in the first buffer B1. The second analog data signal sampled by the second sampling switch SS2 is then stored in the second buffer B2. Subsequently, the third analog data signal sampled by the third sampling switch SS3 is stored in the third buffer B3. Continuing with this sequence, the third analog data signal sampled by the m-th sampling switch SSm is finally stored in the m-th buffer Bm.

Thereafter, the output controller 302*a* operates. That is, the output switches OS1 to OSm included in the output controller 302*a* are simultaneously turned on by a line pass signal LPS supplied from a source external to the output controller 302*a*.

The line pass signal LPS is supplied simultaneously to the output switches OS1 to OSm after one horizontal period elapses at a time after the last sampling switch (the m-th sampling switch SSm) is turned on.

In other words, the line pass signal LPS is supplied following the m-th sampling scan pulse SPm. The output line pass signal LPS is supplied to the gates of the output switches OS1 to OSm in a simultaneous or substantially simultaneous manner. The LPS signal may be supplied during a margin period present between successive horizontal periods.

The turned-on output switches OS1 to OSm simultaneously output the sampled analog data signals respectively stored in the buffers B1 to Bm of the first buffer unit 301*b*. The sampled analog data signals output via the output switches OS1 to OSm are supplied to the buffers B1' to Bm' of the second buffer unit 302*b*, respectively. After buffering the sampled analog data signals, the buffers B1' to Bm' of the second buffer unit 302*b* supply the buffered signals to the data lines DL1 to DLm in a simultaneous manner, respectively.

That is, the first buffer B1' buffers the sampled first analog data signal, and supplies the buffered first analog data signal to the first data line DL1. The second buffer B2' buffers the sampled second analog data signal, and supplies the buffered second analog data signal to the second data line DL2. The third buffer B3' buffers the sampled third analog data signal, and supplies the buffered third analog data signal to the third data line DL3. Continuing with this sequence, the m-th buffer Bm' buffers the sampled third analog data signal, and supplies the buffered analog data signal to the m-th data line DLm.

The first to m-th data lines DL1 to DLm each have the same charge start time and the same charging period because respective sampled analog data signals are simultaneously supplied to the first to m-th data lines. In accordance with the column inversion driving scheme, the odd data lines DL1, DL3, DL5 . . . , DLm-1 may be charged with the sampled positive analog data signals, while the even data lines DL2, DL4, DL6 . . . , DLm may be charged with the sampled negative analog data signals.

Each pixel cell of the display displays a unit image in accordance with the sampled analog data signal supplied from the associated data line. The pixel cells adjacent to each other in a horizontal direction may have opposite polarities in accordance with the column inversion driving scheme.

The pixel cells associated with a horizontal line of the display simultaneously receive sampled analog data signals in the above-described manner, to display an image. After one frame period is ended after completion of operations associated with a plurality of horizontal periods corresponding to one frame period, the next frame period is begun.

In the next frame period, the polarities of the first to third analog data signals Data_R, Data_G, and Data_B respectively supplied to the first to third data transfer lines DT1 to DT3 are inverted to be opposite of those from the first period. As a result, in the next frame period, the (6k+1)-th sampling switches SS1, SS7, SS13, . . . , SSm-5 sample the negative first analog data signal Data_R, whereas the (6k+4)-th sampling switches SS4, SS10, SS16, . . . , SSm-2 sample the positive first analog data signal Data_R.

In addition, the (6k+2)-th sampling switches SS2, SS8, SS14, . . . , SSm-4 sample the positive second analog data signal Data_G, whereas the (6k+5)-th sampling switches SS5, SS11, SS17, . . . , SSm-1 sample the negative second analog data signal Data_G.

On the other hand, the (6k+3)-th sampling switches SS3, SS9, SS15, . . . , SSm-3 sample the negative third analog data signal Data_B, whereas the (6k+6)-th sampling switches SS6, SS12, SS18, . . . , SSm sample the positive third analog data signal Data_B.

Accordingly, the sampled negative analog data signals are supplied to the odd data lines DL1, DL3, DL5, . . . , DLm-1, whereas the sampled positive analog data signals are supplied to the even data lines DL2, DL4, DL6, . . . , DLm, respectively.

The line pass signal LPS may be synchronized with the m-th sampling scan pulse SPm. That is, the m-th sampling scan pulse SPm and line pass signal LPS may be simultaneously output. In this case, the sampled analog data signals respectively stored in the first to m-th buffers B1 to Bm are simultaneously output at the point of time when the third analog data signal Data_B is stored in the m-th buffer Bm after being sampled by the m-th sampling switch SSm. The line pass signal LPS may be supplied from the timing controller.

The buffers B1 to Bm of the first buffer unit 301*b* and the buffers B1' to Bm' of the second buffer unit 302*b* are analog buffers having the same driving range. That is, each of the buffers B1 to Bm and B1' to Bm' receives a voltage swing between a maximum grayscale voltage of a negative analog data signal and a maximum grayscale voltage of a positive analog data signal because both a sampled positive analog data signal and a sampled negative analog data signal are to be buffered.

For example, assuming for the purposes of illustration that the negative analog data signal has a minimum grayscale voltage of −1V and a maximum grayscale voltage −5V, and the positive analog data signal has a minimum grayscale voltage of +1V and a maximum grayscale voltage +5V, the buffers must accommodate a voltage swing between −5V and +5V. Accommodating the increased range of the voltage slightly increases the power consumption of the buffers B1 to Bm and B1' to Bm'.

Hereinafter, a drive circuit of a display device according to a second embodiment of the present invention and configured to reduce the power consumption of buffers, will be described.

Figure 6:
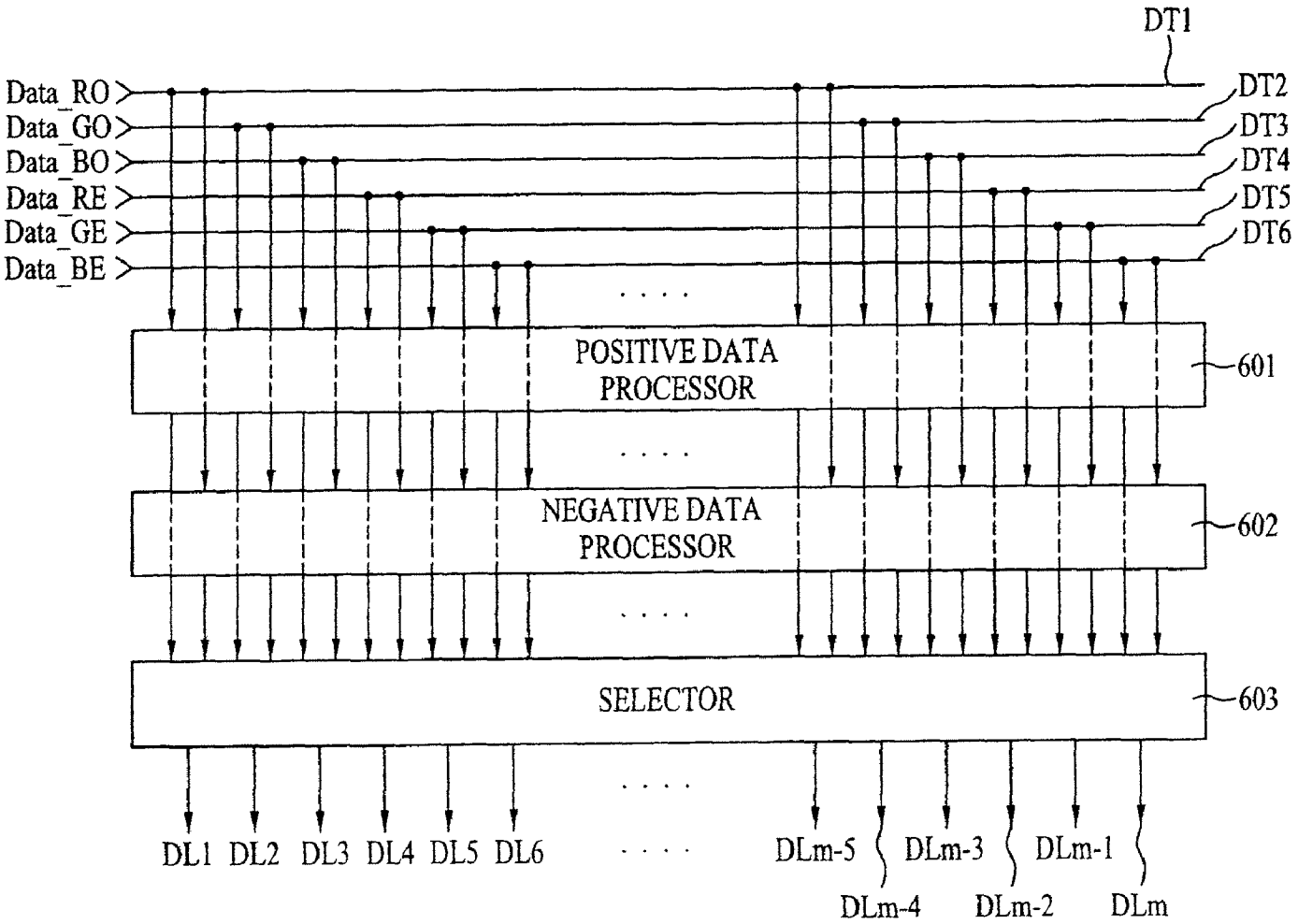
FIG. 6 is a circuit diagram illustrating a drive circuit of the display device according to a second embodiment of the present invention.

FIG. 6 is a circuit diagram illustrating the drive circuit of the display device according to the second embodiment of the present invention.

As shown in FIG. 6, a drive circuit of the display device according to the second embodiment of the present invention includes: first to sixth data transfer lines DT1 to DT6 for transferring image information analog data signals Data_RO, Data_GO, Data_BO, Data_RE, Data_GE, and Data_BE, respectively; a positive data processor 601 for processing positive analog data signals supplied from the data transfer lines DT1 to DT6; a negative-data processor 602 for processing negative analog data signals supplied from the data transfer lines DT1 to DT6, and a selector 603 for selecting a part of the positive analog data signals sampled by the positive data processor 601 and a part of the negative analog data signals sampled by the negative-data processor 602, and simultaneously supplying the selected positive and negative analog data signals to a display.

First to third odd analog data signals Data_RO, Data_GO, and Data_BO are supplied to the first to third data transfer lines DT1 to DT3, whereas first to third even analog data signals Data_RE, Data_GE, and Data_BE are supplied to the fourth to sixth data transfer lines DT4 to DT6.

The first odd and even analog data signals Data_RO and Data_RE are signals having information related to the display of red. The second odd and even analog data signals Data_GO and Data_GE are signals having information related to the display of green. The third odd and even analog data signals Data_BO and Data_BE are signals having information related to the display of blue.

In the second embodiment of the present invention, a reduction in electromagnetic interference (EMI) may be achieved by grouping the analog data signals into odd and even groups, grouping the 6 data transfer lines into two groups respectively corresponding to the odd and even groups of the analog data signals, and transferring each analog data signal to an associated one of the data transfer lines.

The drive circuit of the display device according to the second embodiment of the present invention may include at least one data transfer line. For example three data transfer lines as described in conjunction with the first embodiment of the present invention may be included.

The positive data processor 601 samples the positive and negative analog data signals supplied from the data transfer lines DT1 to DT6, and supplies the sampled positive and negative analog data signals to the selector 603.

Similarly, the negative-data processor 602 samples the positive and negative analog data signals supplied from the data transfer lines DT1 to DT6, and supplies the sampled positive and negative analog data signals to the selector 603.

The configuration of the positive data processor 601 will be described in more detail hereinafter.

Figure 7:
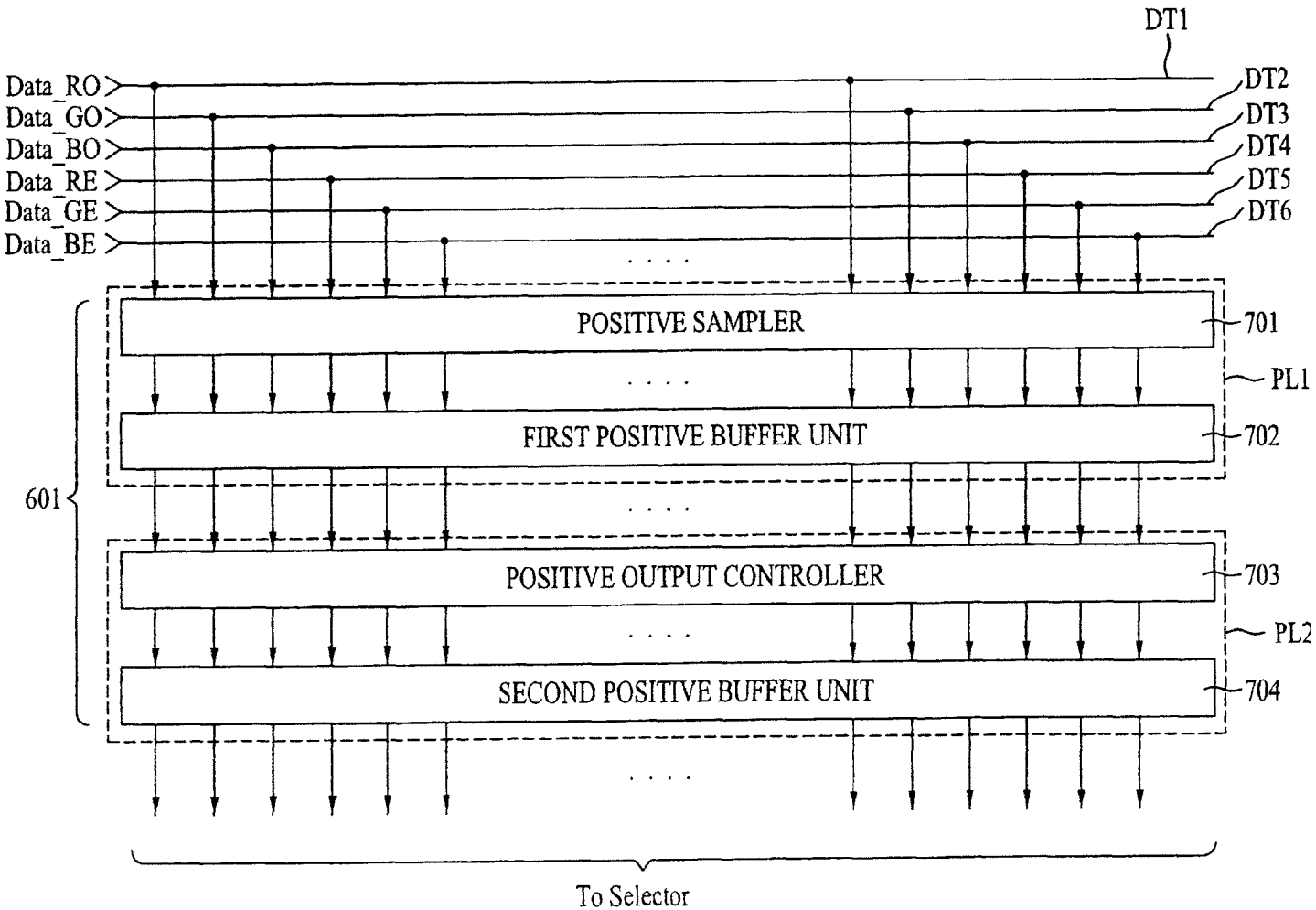
FIG. 7 is a circuit diagram illustrating configuration details of the positive data processor shown in FIG. 6.

FIG. 7 is a circuit diagram illustrating details of the positive data processor shown in FIG. 6.

As shown in FIG. 7, the positive data processor 601 includes a first positive latch PL1 for sequentially sampling the positive and negative analog data signals from the data transfer lines DT1 to DT6, and sequentially storing the sampled positive and negative analog data signals, and a second positive latch PL2 for simultaneously outputting the sampled positive and negative analog data signals from the first positive latch PL1.

The first positive latch PL1 includes a positive sampler 701 and a first positive buffer unit 702. The positive sampler 701 and first positive buffer unit 702 are identical to the sampler 301*a* and first buffer unit 301*b* included in the first latch 301 according to the first embodiment of the present invention.

The second positive latch PL2 includes a positive output controller 703 and a second positive buffer unit 704. The positive output controller 703 and second positive buffer unit 704 are identical to the output controller 302*a* and second buffer unit 302*b* included in the second latch 302 according to the first embodiment of the present invention.

The sampled positive and negative analog data signals output from the second positive buffer unit 704 are supplied to the selector 603.

The positive sampler 701 receives the positive and negative analog data signals from the first to sixth data transfer lines DT1 to DT6, and sequentially samples the received analog data signals.

The first positive buffer unit 702 sequentially stores the positive and negative analog data signals sampled by the positive sampler 701, buffers the sampled signals, and outputs the buffered signals.

The positive output controller 703 simultaneously outputs the sampled positive and negative analog data signals stored in the first positive buffer unit 702.

The second positive buffer unit 704 buffers the sampled positive and negative analog data signals output from the positive output controller 703, and supplies the buffered signals to the selector 603.

Hereinafter, the configuration of the negative data processor 602 will be described in more detail.

Figure 8:
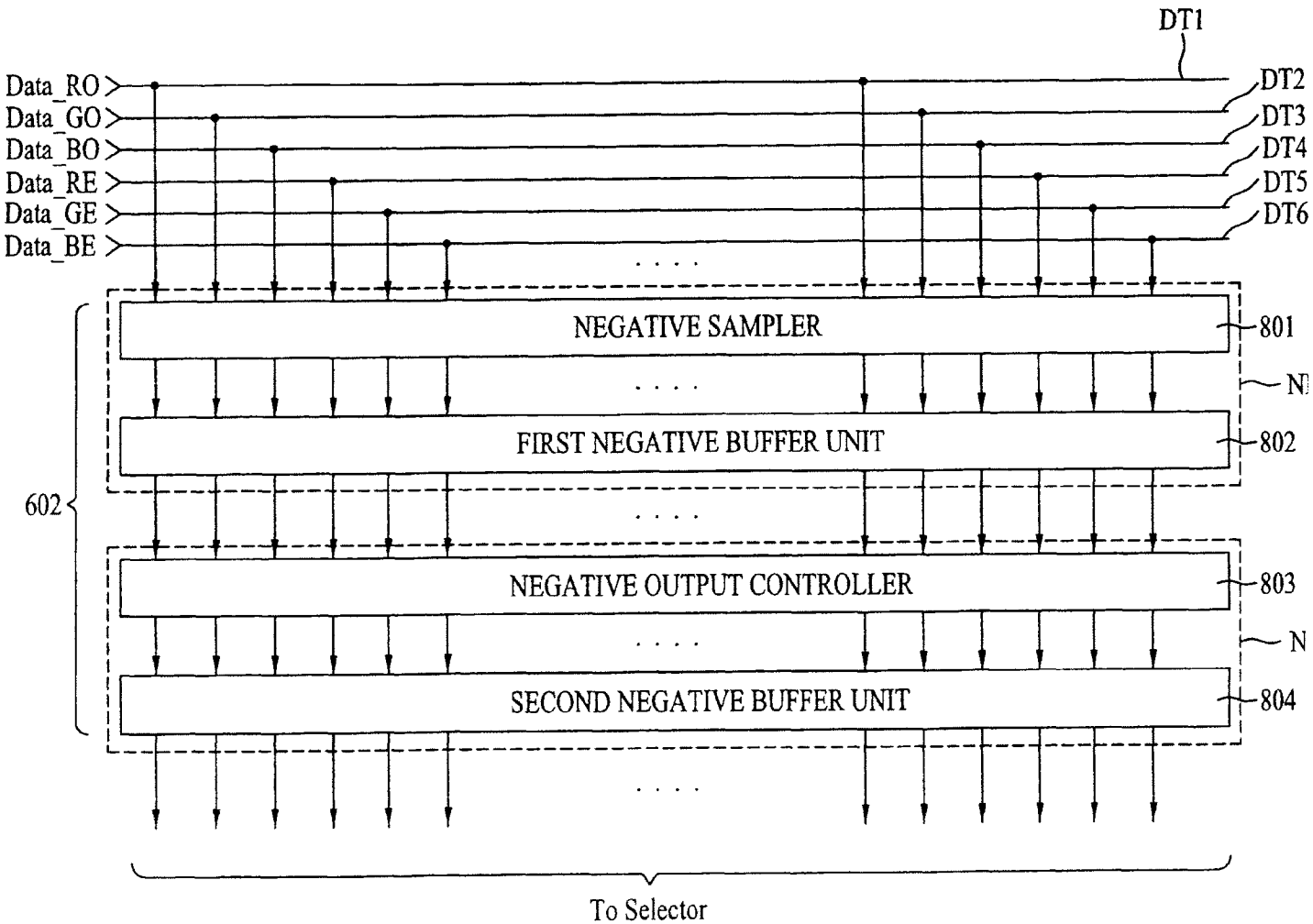
FIG. 8 is a circuit diagram illustrating configuration details of the negative data processor shown in FIG. 6.

FIG. 8 is a circuit diagram illustrating a detailed configuration of the negative data processor shown in FIG. 6.

As shown in FIG. 8, the negative data processor 602 includes a first negative latch NL1 for sequentially sampling the positive and negative analog data signals from the data transfer lines DT1 to DT6, and sequentially storing the sampled positive and negative analog data signals, and a second negative latch NL2 for simultaneously outputting the sampled positive and negative analog data signals from the first negative latch NL1.

The first negative latch NL1 includes a negative sampler 801 and a first negative buffer unit 802. The negative sampler 801 and first negative buffer unit 802 are identical to the sampler 301*a* and first buffer unit 301*b* included in the first latch 301 according to the first embodiment of the present invention.

The second negative latch NL2 includes a negative output controller 803 and a second negative buffer unit 804. The negative output controller 803 and second negative buffer unit 804 are identical to the output controller 302*a* and second buffer unit 302*b* included in the second latch 302 according to the first embodiment of the present invention.

The sampled positive and negative analog data signals output from the second negative buffer unit 804 are supplied to the selector 603.

The negative sampler 801 receives the positive and negative analog data signals from the first to sixth data transfer lines DT1 to DT6, and sequentially samples the received analog data signals.

The first negative buffer unit 802 sequentially stores the positive and negative analog data signals sampled by the negative sampler 801, buffers the sampled signals, and outputs the buffered signals.

The negative output controller 803 simultaneously outputs the sampled positive and negative analog data signals stored in the first negative buffer unit 802.

The second negative buffer unit 804 buffers the sampled positive and negative analog data signals output from the negative output controller 803, and supplies the buffered signals to the selector 603.

The positive and negative samplers 701 and 801, first positive and negative buffer units 702 and 802, positive and negative output controllers 703 and 803, and second positive and negative buffer units 704 and 804 will be described in more detail hereinafter.

Figure 9:
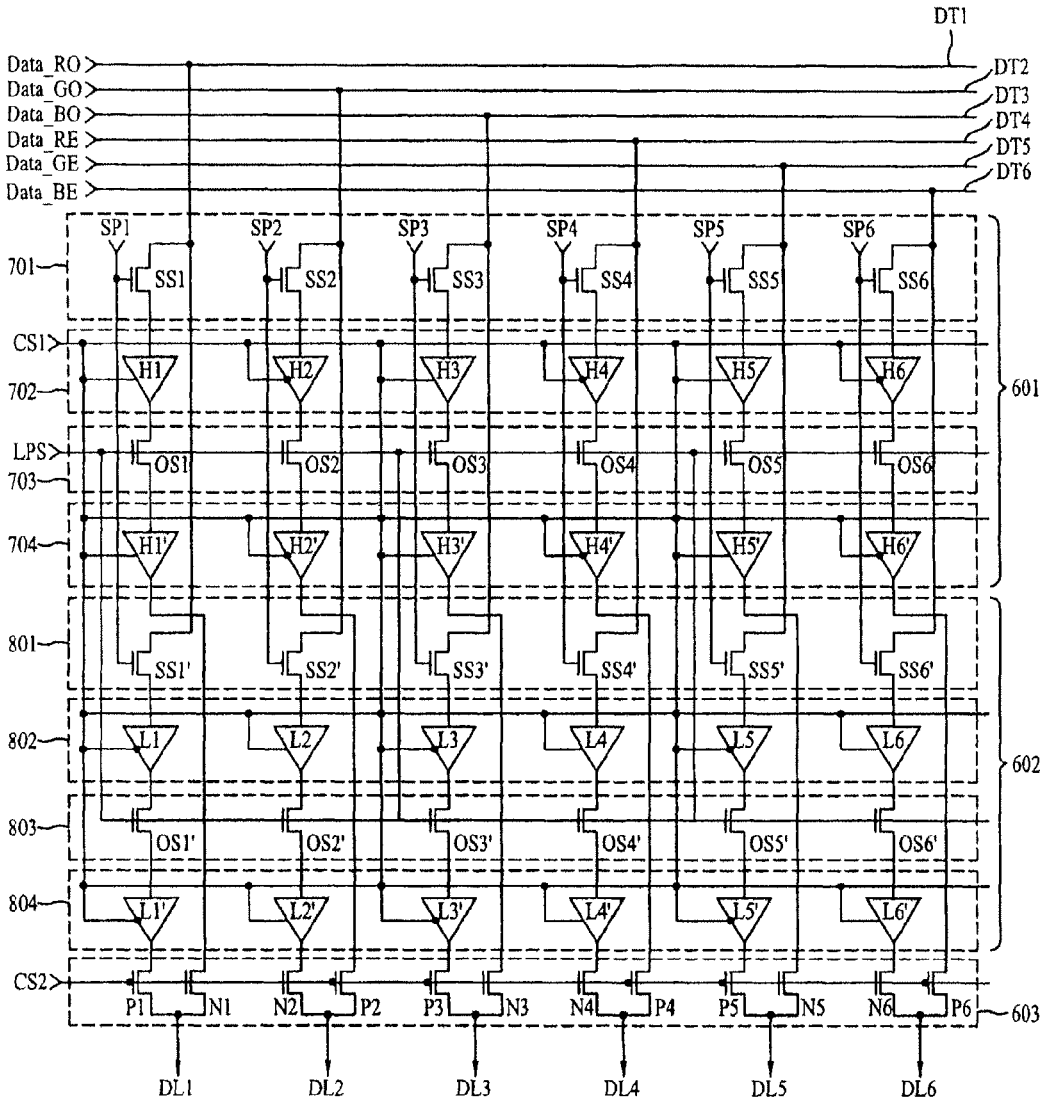
FIG. 9 is a circuit diagram illustrating configurations details of the positive and negative samplers, first positive and negative buffer units, positive and negative output controllers, and second positive and negative buffer units shown in FIGS. 7 and 8.
Figure 10:
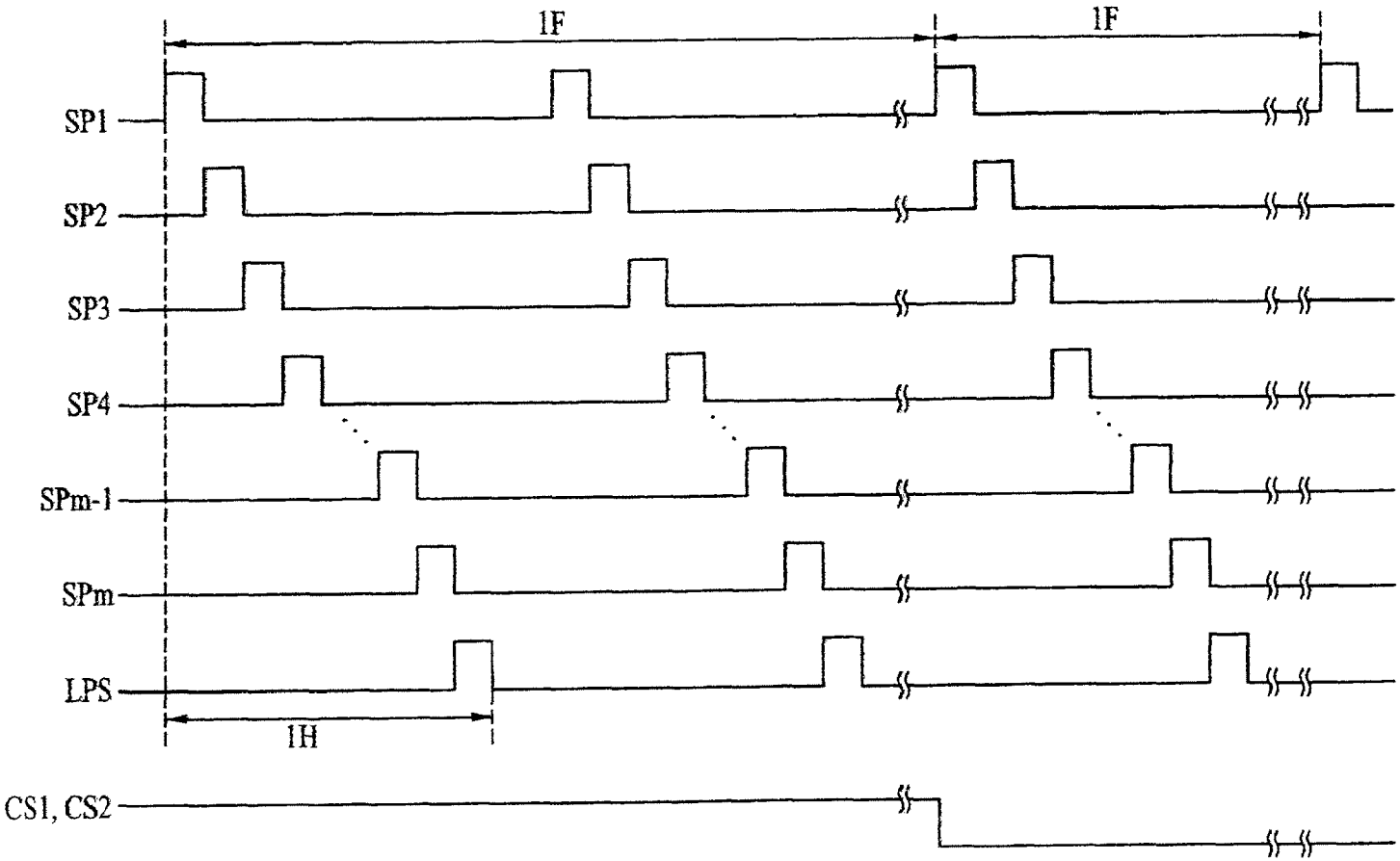
FIG. 10 is a timing diagram showing various control signals supplied to respective constituent elements shown in FIG. 9.

FIG. 9 is a circuit diagram illustrating detailed configurations of the positive and negative samplers, first positive and negative buffer units, positive and negative output controllers, and second positive and negative buffer units shown in FIGS. 7 and 8. FIG. 10 is a timing diagram of various control signals supplied to respective constituent elements shown in FIG. 9.

As shown in FIG. 9, the positive sampler 701 includes a plurality of positive sampling switches SS1 to SSm. The first positive buffer unit 702 includes a plurality of positive buffers H1 to Hm. The positive output controller 703 includes a plurality of positive output switches OS1 to OSm. The second positive buffer unit 704 includes a plurality of positive buffers H1' to Hm'.

As shown in FIG. 10, the positive sampling switches SS1 to SSm included in the positive sampler 701 are sequentially turned on within one horizontal period in response to first to m-th sampling scan pulses SP1 to SPm sequentially supplied from a shift register, respectively.

That is, the first positive sampling switch SS1 is first turned on within a horizontal period in response to the first sampling scan pulse SP1. Next, the second positive sampling switch SS2 is secondarily turned on within the same horizontal period in response to the second sampling scan pulse SP2. Next, the third positive sampling switch SS3 is thirdly turned on within the same horizontal period in response to the third sampling scan pulse SP3. In accordance with this order, the m-th positive switch SSm is finally turned on within the horizontal period in response to the m-th sampling scan pulse SPm.

Meanwhile, when any one of the positive sampling switches SS1 to SSm is turned on, the remaining positive sampling switches are maintained in an OFF state.

Each of the positive sampling switches SS1 to SSm includes a gate connected to the shift register, a source connected to an associated one of the first to sixth data transfer lines DT1 to DT6, and a drain connected to an input terminal of an associated one of the positive buffers (namely, the positive buffers of the first positive buffer unit 702).

Each of the (6k+1)-th positive sampling switches SS1, SS7, SS13, . . . , SSm-5 of the positive sampling switches SS1 to SSm function to sample the first odd analog data signal Data_RO. Each of the (6k+2)-th positive sampling switches SS2, SS8, SS14, . . . , SSm-4 function to sample the second odd analog data signal Data_GO. Each of the (6k+3)-th positive sampling switches SS3, SS9, SS15, . . . , SSm-3 function to sample the third odd analog data signal Data_BO. Each of the (6k+4)-th positive sampling switches SS4, SS10, SS16, . . . , SSm-2 function to sample the first even analog data signal Data_RE. Each of the (6k+5)-th positive sampling switches SS5, SS11, SS17, . . . , SSm-1 function to sample the second even analog data signal Data_GE. Each of the (6k+6)-th positive sampling switches SS6, SS12, SS18, . . . , SSm function to sample the third even analog data signal Data_BE. Here, "k" is a non-negative integer.

To this end, the sources of the (6k+1)-th positive sampling switches SS1, SS7, SS13 . . . SSm-5 are connected in common to the first data transfer line DT1 which transfers the first odd analog data signal Data_RO. Similarly, the sources of the (6k+2)-th positive sampling switches SS2, SS8, SS14, . . . , SSm-4 are connected in common to the second data transfer line DT2 which transfers the second odd analog data signal Data_GO. The sources of the (6k+3)-th positive sampling switches SS3, SS9, SS15, . . . , SSm-3 are connected in common to the third data transfer line DT3 which transfers the third odd analog data signal Data_BO. The sources of the (6k+4)-th positive sampling switches SS4, SS10, SS16, . . . , SSm-2 are connected in common to the fourth data transfer line DT4 which transfers the first even analog data signal Data_RE. The sources of the (6k+5)-th positive sampling switches SS5, SS11, SS17, . . . , SSm-1 are connected in common to the fifth data transfer line DT5 which transfers the second even analog data signal Data_GE. The sources of the (6k+6)-th positive sampling switches SS6, SS12, SS18 . . . SSm are connected in common to the sixth data transfer line DT6 which transfers the third even analog data signal Data_BE.

The positive output switches OS1 to OSm included in the positive output controller 703 are simultaneously turned on in response to a line pass signal LPS externally supplied to the positive output controller 703, to simultaneously output the sampled positive and negative analog data signals respectively stored in the positive buffers H1 to Hm of the first positive buffer unit 702. The sampled positive and negative analog data signals output from the positive output switches OS1 to OSm are simultaneously supplied to the positive buffers H1' to Hm' of the second positive buffer unit 704, respectively.

To this end, the gates of the positive output switches OS1 to OSm are connected in common to a transfer line which transfers the line pass signal LPS. In addition, the sources of the positive output switches OS1 to OSm are connected to respective output terminals of the associated positive buffers (namely, the positive buffers H1 to Hm of the first positive buffer unit 702). The drains of the positive output switches OS1 to OSm are connected to respective input terminals of the associated buffers (namely, the positive buffers H1' to Hm' of the second positive buffer unit 704).

The positive buffers H1' to Hm' of the second positive buffer unit 704 buffer the sampled positive and negative analog data signals supplied via the positive output switches OS1 to OSm, respectively, and simultaneously supply the buffered signals to the selector 603.

As shown in FIG. 9, the negative sampler 801 includes a plurality of negative sampling switches SS1' to SSm'. The first negative buffer unit 802 includes a plurality of negative buffers L1 to Lm. The negative output controller 803 includes a plurality of negative output switches OS1' to OSm'. The second negative buffer unit 804 includes a plurality of negative buffers L1' to Lm'.

The negative sampling switches SS1' to SSm' included in the negative sampler 801 are sequentially turned on within one horizontal period in response to the first to m-th sampling scan pulses SP1 to SPm sequentially supplied from the shift register, respectively.

That is, the first negative sampling switch SS1' is first turned on within one horizontal period in response to the first sampling scan pulse SP1. Next, the second negative sampling switch SS2' is secondarily turned on within the horizontal period in response to the second sampling scan pulse SP2. Next, the third negative sampling switch SS3' is thirdly turned on within the horizontal period in response to the third sampling scan pulse SP3. In accordance with this order, the m-th negative switch SSm' is finally turned on within the horizontal period in response to the m-th sampling scan pulse SPm. Meanwhile, when one of the negative sampling switches SS1 to SSm is turned on, the remaining negative sampling switches are maintained in an OFF state.

The corresponding positive and negative sampling switches are simultaneously turned on.

Each of the negative sampling switches SS1' to SSm' includes a gate connected to the shift register, a source connected to an associated one of the first to sixth data transfer lines DT1 to DT6, and a drain connected to an input terminal of an associated one of the negative buffers (namely, the negative buffers of the first negative buffer unit 802).

Each of the (6k+1)-th negative sampling switches SS1', SS7', SS13' . . . SSm-5' of the negative sampling switches SS1' to SSm' function to sample the first odd analog data signal Data_RO. Each of the (6k+2)-th negative sampling switches SS2', SS8', SS14' . . . SSm-4' function to sample the second odd analog data signal Data_GO. Each of the (6k+3)-th negative sampling switches SS3', SS9', SS15' . . . SSm-3' function to sample the third odd analog data signal Data_BO. Each of the (6k+4)-th negative sampling switches SS4', SS10', SS16' . . . SSm-2' function to sample the first even analog data signal Data_RE. Each of the (6k+5)-th negative sampling switches SS5', SS11', SS17' . . . SSm-1' function to sample the second even analog data signal Data_GE. Each of the (6k+6)-th negative sampling switches SS6', SS12', SS18' . . . SSm' function to sample the third even analog data signal Data_BE.

To this end, the sources of the (6k+1)-th negative sampling switches SS1', SS7', SS13', . . . , SSm-5' are connected in common to the first data transfer line DT1 which transfers the first odd analog data signal Data_RO. Similarly, the sources of the (6k+2)-th negative sampling switches SS2', SS8', SS14', . . . , SSm-4' are connected in common to the second data transfer line DT2 which transfers the second odd analog data signal Data_GO. The sources of the (6k+3)-th negative sampling switches SS3', SS9', SS15', . . . , SSm-3' are connected in common to the third data transfer line DT3 which transfers the third odd analog data signal Data_BO. The sources of the (6k+4)-th negative sampling switches SS4', SS10', SS16', . . . , SSm-2' are connected in common to the fourth data transfer line DT4 which transfers the first even analog data signal Data_RE. The sources of the (6k+5)-th negative sampling switches SS5', SS11', SS17', . . . , SSm-1' are connected in common to the fifth data transfer line DT5 which transfers the second even analog data signal Data_GE. The sources of the (6k+6)-th negative sampling switches SS6', SS12', SS18', . . . , SSm' are connected in common to the sixth data transfer line DT6 which transfers the third even analog data signal Data_BE.

The negative output switches OS1' to OSm' included in the negative output controller 803 are simultaneously turned on in response to the externally-supplied line pass signal LPS, to simultaneously output the sampled positive and negative analog data signals respectively stored in the negative buffers L1 to Lm of the first negative buffer unit 802. The sampled positive and negative analog data signals output from the negative output switches OS1' to OSm' are simultaneously supplied to the negative buffers L1' to Lm' of the second negative buffer unit 804, respectively.

To this end, the gates of the negative output switches OS1' to OSm' are connected in common to the transfer line which transfers the line pass signal LPS. In addition, the sources of the negative output switches OS1' to OSm' are connected to respective output terminals of the associated negative buffers (namely, the negative buffers L1 to Lm of the first negative buffer unit 802). The drains of the negative output switches OS1' to OSm' are connected to respective input terminals of the associated buffers (namely, the negative buffers L1' to Lm' of the second negative buffer unit 804).

The negative buffers L1' to Lm' of the second buffer unit 804 buffer the sampled positive and negative analog data signals supplied via the negative output switches OS1' to OSm', respectively, and simultaneously supply the buffered signals to the selector 603.

The positive buffers H1 to Hm and H1' to Hm' included in the first and second positive buffer units 702 and 704 and the negative buffers L1 to Lm and L1' to Lm' of the first and second negative buffer units 804 are analog buffers having different driving ranges, respectively.

That is, each of the positive buffers H1 to Hm and H1' to Hm' receives a voltage ranging between minimum and maximum grayscale voltages of a positive analog data signal. On the other hand, each of the negative buffers L1 to Lm and L1' to Lm' receives a voltage ranging between minimum and maximum grayscale voltages of a negative analog data signal.

As a result, the power consumption of the positive buffers H1 to Hm and H1' to Hm' and negative buffers L1 to Lm and L1' to Lm' corresponds to about ¼ of that of the buffers according to the first embodiment.

The odd ones and even ones of the positive buffers H1 to Hm included in the first positive buffer unit 702 operate alternately at intervals of a predetermined time. That is, the odd positive buffers H1, H3, H5, . . . , Hm-1 operate in an odd frame period, whereas the even positive buffers H2, H4, H6, . . . , Hm operate in an even frame period.

To this end, a first control signal CS1 is supplied to the positive buffers H1 to Hm. The first control signal CS1 has a logic voltage alternating between a high logic voltage level and a low logic voltage level on a frame basis. The odd positive buffers H1, H3, H5 . . . Hm-1 of the positive buffers H1 to Hm are turned on in response to the high logic voltage of the first control signal CS1, and are turned off in response to the low logic voltage of the first control signal CS1.

Conversely, the even positive buffers H2, H4, H6 . . . Hm are turned on in response to the low logic voltage of the first control signal CS1, and are turned off in response to the high logic voltage of the first control signal CS1.

The odd positive buffers H1', H3', H5' . . . Hm-1' and even positive buffers H2', H4', H6' . . . Hm' included in the second positive buffer unit 704 operate alternately at predetermined time intervals. That is, the odd positive buffers H1', H3', H5' . . . Hm-1' operate in an odd frame period, whereas the even positive buffers H2', H4', H6' . . . Hm' operate in an even frame period.

To this end, the first control signal CS1 is also supplied to the positive buffers H1' to Hm'. The odd positive buffers H1', H3', H5', . . . , Hm-1' of the positive buffers H1' to Hm' are turned on in response to the high logic voltage of the first control signal CS1, and are turned off in response to the low logic voltage of the first control signal CS1.

Conversely, the even positive buffers H2', H4', H6' . . . Hm' are turned on in response to the low logic voltage of the first control signal CS1, and are turned off in response to the high logic voltage of the first control signal CS1.

Sampled negative analog data signals are output from the positive buffers turned off in response to the first control signal in each frame period, without any signal processing. That is, the positive buffers turned off in response to the first control signal do not perform any specific operation for buffering a sampled negative analog data signal. As a result, the turned-off positive buffers consume substantially no electric power.

In other words, in odd frame periods, only the odd positive buffers consume electric power, while the even positive buffers consume substantially no electric power. On the other hand, in even frame periods, only the even positive buffers consume electric power, and the odd positive buffers consume substantially no electric power.

Thus, m/2 sampled positive analog data signals and m/2 sampled negative analog data signals are output from respective positive buffers in each frame period. The m/2 sampled negative analog data signals output from the turned-off positive buffers are abnormal negative signals each having a grayscale other than an originally-intended grayscale because the turned-off positive buffers do not perform a buffering operation.

Meanwhile, the odd negative buffers L1, L3, L5, . . . , Lm-1 and even negative buffers L2, L4, L6, . . . , Lm included in the first negative buffer unit 802 operate alternately at predetermined time intervals. That is, the even negative buffers L2, L4, L6, . . . , Lm operate in an odd frame period, whereas the odd negative buffers L1, L3, L5, . . . , Lm-1 operate in an even frame period.

To this end, the first control signal CS1 is supplied to the negative buffers L1 to Lm. The even negative buffers L2, L4, L6 . . . Lm of the negative buffers L1 to Lm are turned on in response to the high logic voltage of the first control signal CS1, and are turned off in response to the low logic voltage of the first control signal CS1.

Conversely, the odd negative buffers L1, L3, L5 . . . Lm-1 are turned on in response to the low logic voltage of the first control signal CS1, and are turned off in response to the high logic voltage of the first control signal CS1.

The odd negative buffers L1', L3', L5' . . . Lm-1' and even negative buffers L2', L4', L6' . . . Lm' included in the second negative buffer unit 804 operate alternately at predetermined time intervals. That is, the even negative buffers L2', L4', L6' . . . Lm' operate in an odd frame period, whereas the odd negative buffers L1', L3', L5' . . . Lm-1' operate in an even frame period.

To this end, the first control signal CS1 is also supplied to the negative buffers L1' to Lm'. The even negative buffers L2', L4', L6' . . . Lm' of the negative buffers H1' to Hm' are turned on in response to the high logic voltage of the first control signal CS1, and are turned off in response to the low logic voltage of the first control signal CS1.

Conversely, the odd negative buffers L1', L3', L5' . . . Lm-1' are turned on in response to the low logic voltage of the first control signal CS1, and are turned off in response to the high logic voltage of the first control signal CS1.

Sampled positive analog data signals are output from the negative buffers turned off in response to the first control signal in each frame period, without any signal processing. That is, the negative buffers turned off in response to the first control signal do not perform any specific operation for buffering a sampled positive analog data signal. As a result, the turned-off negative buffers consume substantially no electric power.

In other words, in odd frame periods, only the even negative buffers consume electric power, while the odd negative buffers consume substantially no electric power. On the other hand, in even frame periods, only the odd negative buffers consume electric power, while the even negative buffers consume substantially no electric power.

Thus, m/2 sampled negative analog data signals and m/2 sampled positive analog data signals are output from respective negative buffers in each frame period. In this case, the m/2 sampled positive analog data signals output from the turned-off negative buffers are abnormal positive signals each having a grayscale other than an originally-intended grayscale because the turned-off negative buffers do not perform a buffering operation.

The selector 603 receives the m/2 sampled positive analog data signals, m/2 abnormal negative signals, m/2 sampled negative analog data signals, and m/2 abnormal positive signals, selects the m/2 sampled positive analog data signals and m/2 sampled negative analog data signals, and simultaneously supplies the selected signals to m data lines, respectively.

The selector 603 receives the m/2 sampled positive analog data signals and m/2 abnormal negative signals from respective positive buffers, selects the m/2 sampled positive analog data signals, and simultaneously supplies the selected m/2 sampled positive analog data signals to m/2 data lines, respectively.

To this end, the selector 603 includes a plurality of PMOS switches P1 to Pm and a plurality of NMOS switches N1 to Nm, as shown in FIG. 9.

The PMOS switches P1 to Pm and NMOS switches N1 to Nm are alternately arranged to form switch pairs each including one PMOS switch and one NMOS switch. The PMOS and NMOS switches in each switch pair are coupled to each other in an inverter configuration and each switch pair is connected to an associated one of the data lines.

The odd NMOS switches N1, N3, N5 . . . Nm-1 of the NMOS switches N1 to Nm have source terminals connected to the positive data processor 601, respectively.

In particular, the source terminals of the odd NMOS switches N1, N3, N5 . . . Nm-1 are connected to the odd positive buffers H1', H3', H5' . . . Hm-1' included in the second positive buffer unit 704. The odd NMOS switches N1, N3, N5 . . . Nm-1 also have drain terminals connected to the odd data lines DL1, DL3, DL5 . . . DLm-1, respectively.

The even NMOS switches N2, N4, N6 . . . Nm of the NMOS switches N1 to Nm have source terminals connected to the negative data processor 602, respectively.

In particular, the source terminals of the even NMOS switches N2, N4, N6 . . . Nm are connected to the even negative buffers L2', L4', L6' . . . Lm' included in the second negative buffer unit 804. The even NMOS switches N2, N4, N6 . . . Nm also have drain terminals connected to the even data lines DL2, DL4, DL6 . . . DLm, respectively.

The odd PMOS switches P1, P3, P5 . . . Pm-1 of the PMOS switches P1 to Pm have source terminals connected to the negative data processor 602, respectively.

In particular, the source terminals of the odd PMOS switches P1, P3, P5 . . . Pm-1 are connected to the odd negative buffers L1', L3', L5' . . . Lm-1' included in the second negative buffer unit 804. The odd PMOS switches P1, P3, P5 . . . Pm-1 also have drain terminals connected to the odd data lines DL1, DL3, DL5 . . . DLm-1, respectively.

The even PMOS switches P2, P4, P6 . . . Pm of the PMOS switches P1 to Pm have source terminals connected to the positive data processor 601, respectively.

In particular, the source terminals of the even PMOS switches P2, P4, P6 . . . Pm are connected to the even positive buffers H2', H4', H6' . . . Hm' included in the second positive buffer unit 704. The even PMOS switches P2, P4, P6 . . . Pm also have drain terminals connected to the even data lines DL2, DL4, DL6 . . . DLm, respectively.

The NMOS switches N1 to Nm and PMOS switches P1 to Pm operate alternately on a frame period basis.

That is, the NMOS switches N1 to Nm are turned on in each odd frame period, whereas the PMOS switches P1 to Pm are turned on in each even frame period.

To this end, a second control signal CS2 is supplied to the NMOS switches N1 to Nm and PMOS switches P1 to Pm. The second control signal CS2 has a logic voltage alternating between a high logic voltage level and a low logic voltage level on a frame basis.

The NMOS switches N1 to Nm are turned on in response to the high logic voltage of the second control signal CS2, and are turned off in response to the low logic voltage of the second control signal CS2.

Conversely, the PMOS switches P1 to Pm are turned on in response to the low logic voltage of the second control signal CS2, and are turned off in response to the high logic voltage of the second control signal CS2.

In each odd frame period, the odd NMOS switches N1, N3, N5 . . . Nm-1 and even PMOS switches P2, P4, P6 . . . Pm are turned on. In each even frame period, the even NMOS switches N2, N4, N6 . . . Nm and odd PMOS switches P1, P3, P5 . . . Pm-1 are turned on.

The NMOS and PMOS switches of each switch pair, which are coupled to each other in an inverter fashion, are alternately turned on at intervals of one frame period. Accordingly, sampled positive and negative analog data signals are output through the NMOS switches in one of two successive frame periods, and are output through the PMOS switches in the other frame period.

The first and second control signals CS1 and CS2 may be waveforms having identical timings. Accordingly, it may be possible to control the first positive buffer unit 702, second positive buffer unit 704, first negative buffer unit 802, second negative buffer unit 804, and selector 603, using only one of the first and second control signals CS1 and CS2.

Hereinafter, a method for driving the display device using the drive circuit having the above-described configuration according to the second embodiment of the present invention will now be described in detail.

Figure 11A:
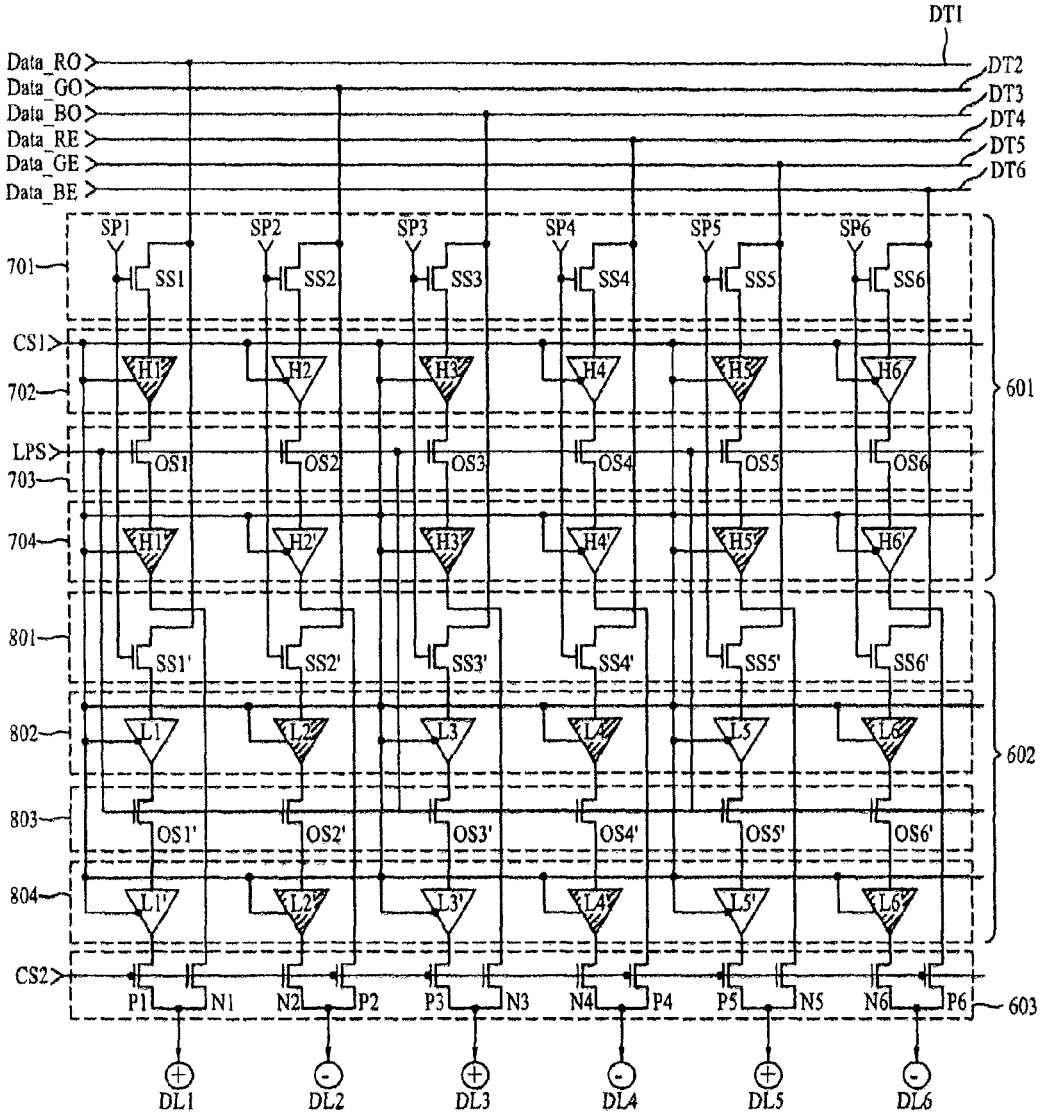
FIGS. 11A and 11B are circuit diagrams illustrating a method for driving the display device using the drive circuit according to the second embodiment of the present invention.
Figure 11B:
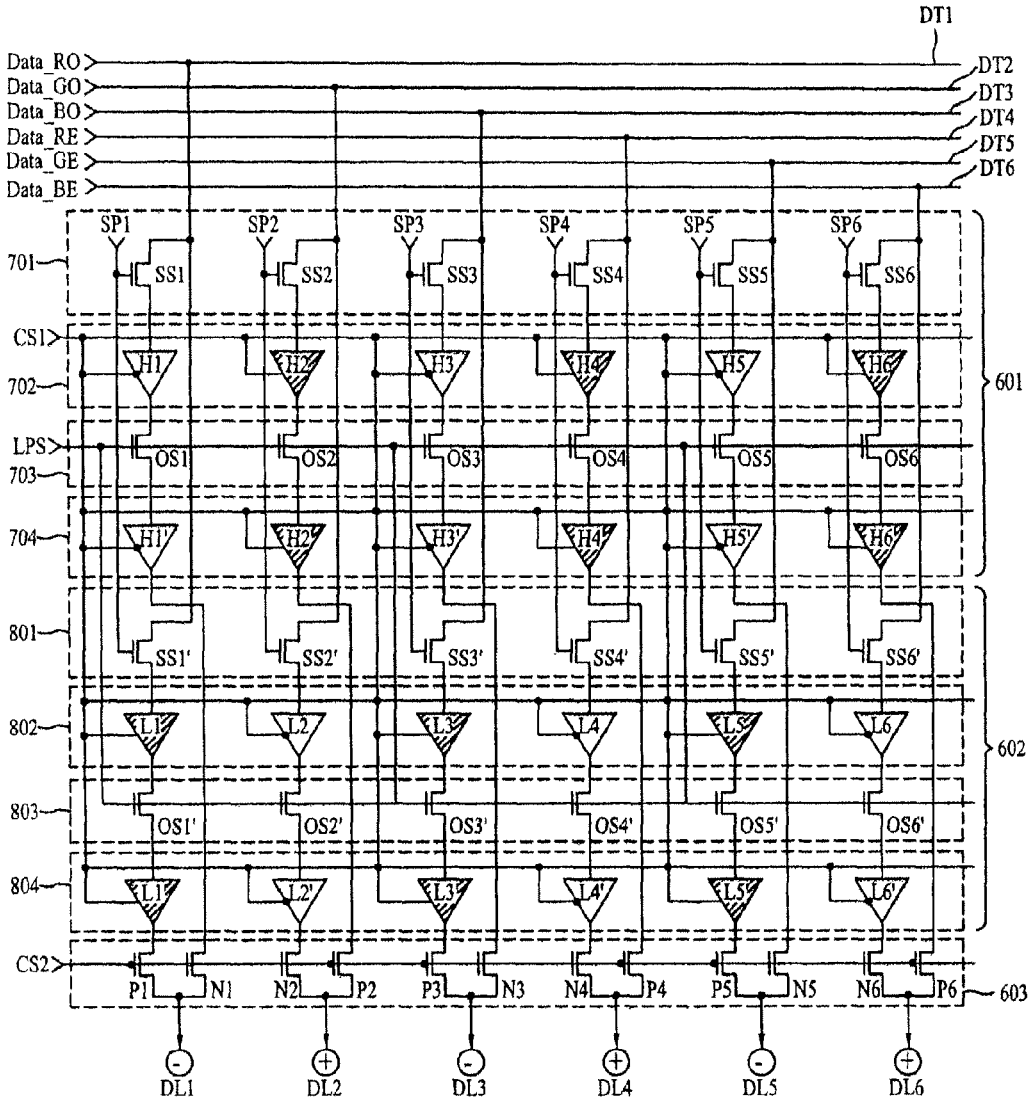

FIGS. 11A and 11B are circuit diagrams illustrating a method for driving the display device using the drive circuit according to the second embodiment of the present invention.

The timing controller controls the timing of the odd and even analog data signals to enable the analog data signals to be supplied to the first to sixth data transfer lines DT1 to DT6, respectively.

That is, in accordance with the timing control operation, the timing controller enables the first odd analog data signal Data_RO to be supplied to the first data transfer line DT1, the second odd analog data signal Data_GO to be supplied to the second data transfer line DT2, the third odd analog data signal Data_BO to be supplied to the third data transfer line DT3, the first even analog data signal Data_RE to be supplied to the fourth data transfer line DT4, the second even analog data signal Data_GE to be supplied to the fifth data transfer line DT5, and the third even analog data signal Data_BE to be supplied to the sixth data transfer line DT6.

It is assumed that, in each odd frame period, the first odd analog data signal Data_RO, third odd analog data signal Data_BO, and second even analog data signal Data_GE are maintained in a positive state, whereas the second odd analog data signal Data_GO, first even analog data signal Data_RE, and third even analog data signal Data_BE are maintained in a negative state.

Additionally, it is assumed that, in each even frame period, the first odd analog data signal Data_RO, third odd analog data signal Data_BO, and second even analog data signal Data_GE are maintained in a negative state, whereas the second odd analog data signal Data_GO, first even analog data signal Data_RE, and third even analog data signal Data_BE are maintained in a positive state.

It is also assumed that the first and second control signals CS1 and CS2 have a high logic voltage level in each odd frame period and have a low logic voltage level in each even frame period.

First, operations in a first frame period will be described.

In sync with the above-described timing, the shift register sequentially supplies sampling scan pulses to the positive and negative sampling switches, respectively. That is, the shift register sequentially outputs the first to m-th sampling scan pulses SP1 to SPm for every horizontal period. The first to m-th sampling scan pulses SP1 to SPm are sequentially supplied to both the first to m-th positive sampling switches SS1 to SSm and the first to m-th negative sampling switches SS1' to SSm', thereby sequentially turning on both the first to m-th positive sampling switches SS1 to SSm and the first to m-th negative sampling switches SS1' to SSm' within one horizontal period, respectively.

Each of the turned-on positive and negative sampling switches samples the analog data signal supplied from the associated data transfer line to which the sampling switch is connected.

In particular, the first positive and negative sampling switches SS1 and SS1', seventh positive and negative sampling switches SS7 and SS7' . . . and (m-5)-th positive and negative sampling switches SSm-5 and SSm-5' connected to the first data transfer line DT1 sample the first odd analog data signal Data_RO supplied from the first data transfer line DT1.

That is, the (6k+1)-th positive and negative sampling switches SS1, SS7, SS13 . . . SSm-5 and SS1', SS7', SS13' . . . SSm-5' sample the first odd analog data signal Data_RO. In this case, both the (6k+1)-th positive sampling switches SS1, SS7, SS13 . . . SSm-5 and the (6k+1)-th negative sampling switches SS1', SS7', SS13' . . . SSm-5' sample the first odd analog data signal Data_RO which is positive.

The second positive and negative sampling switches SS2 and SS2', eighth positive and negative sampling switches SS8 and SS8' . . . and (m-4)-th positive and negative sampling switches SSm-4 and SSm-4' connected to the second data transfer line DT2 sample the second odd analog data signal Data_GO supplied from the second data transfer line DT2.

That is, the (6k+2)-th positive and negative sampling switches SS2, SS8, SS14 . . . SSm-4 and SS2', SS8', SS14' . . . SSm-4' sample the second odd analog data signal Data_GO. In this case, both the (6k+2)-th positive sampling switches SS2, SS8, SS14 . . . SSm-4 and the (6k+2)-th negative sampling switches SS2', SS8', SS14' . . . SSm-4' sample the second odd analog data signal Data_GO which is negative.

The third positive and negative sampling switches SS3 and SS3', ninth positive and negative sampling switches SS9 and SS9' . . . and (m-3)-th positive and negative sampling switches SSm-3 and SSm-3' connected to the third data transfer line DT3 sample the third odd analog data signal Data_BO supplied from the third data transfer line DT3.

That is, the (6k+3)-th positive and negative sampling switches SS3, SS9, SS15 . . . SSm-3 and SS3', SS9', SS15' . . . SSm-3' sample the third odd analog data signal Data_BO. In this case, both the (6k+3)-th positive sampling switches SS3, SS9, SS15 . . . SSm-3 and the (6k+3)-th negative sampling switches SS3', SS9', SS15' . . . SSm-3' sample the third odd analog data signal Data_BO which is positive.

The fourth positive and negative sampling switches SS4 and SS4', tenth positive and negative sampling switches SS10 and SS10' . . . and (m-2)-th positive and negative sampling switches SSm-2 and SSm-2' connected to the fourth data transfer line DT4 sample the first even analog data signal Data_RE supplied from the fourth data transfer line DT4.

That is, the (6k+4)-th positive and negative sampling switches SS4, SS10, SS16 . . . SSm-2 and SS4', SS10', SS16' . . . SSm-2' sample the first even analog data signal Data_RE. In this case, both the (6k+4)-th positive sampling switches SS4, SS10, SS16 . . . SSm-2 and the (6k+4)-th negative sampling switches SS4', SS10', SS16' . . . SSm-2' sample the first even analog data signal Data_RO which is negative.

The fifth positive and negative sampling switches SS5 and SS5', eleventh positive and negative sampling switches SS11 and SS11' . . . and (m-1)-th positive and negative sampling switches SSm-1 and SSm-1' connected to the fifth data transfer line DT5 sample the second even analog data signal Data_GE supplied from the fifth data transfer line DT5.

That is, the (6k+5)-th positive and negative sampling switches SS5, SS11, SS17 . . . SSm-1 and SS5', SS11', SS17' . . . SSm-1' sample the second even analog data signal Data_GE. In this case, both the (6k+5)-th positive sampling switches SS5, SS11, SS17 . . . SSm-1 and the (6k+5)-th negative sampling switches SS5', SS11', SS17' . . . SSm-1' sample the second even analog data signal Data_GE which is positive.

The sixth positive and negative sampling switches SS6 and SS6', twelfth positive and negative sampling switches SS12 and SS12' . . . and m-th positive and negative sampling switches SSm and SSm' connected to the sixth data transfer line DT6 sample the third even analog data signal Data_BE supplied from the sixth data transfer line DT6.

That is, the (6k+6)-th positive and negative sampling switches SS6, SS12, SS18 . . . SSm and SS6', SS12', SS18' . . . SSm' sample the third even analog data signal Data_BE. In this case, both the (6k+6)-th positive sampling switches SS6, SS12, SS18 . . . SSm and the (6k+6)-th negative sampling switches SS6', SS12', SS18' . . . SSm' sample the third even analog data signal Data_BE which is negative.

In a first frame period, the odd positive buffers H1, H3, H5 . . . Hm-1 and H1', H3', H5' . . . Hm-1' of the first and second positive buffer units 702 and 704 are maintained in an ON state, and the even positive buffers H2, H4, H6 . . . Hm and H2', H4', H6' . . . Hm' of the first and second positive buffer units 702 and 704 are maintained in an OFF state. This is because the first control signal CS1 is maintained in a high logic level state during the first frame period.

Conversely, during the first frame period, the even negative buffers L2, L4, L6 . . . Lm and L2', L4', L6' . . . Lm' of the first and second negative buffer units 802 and 804 are maintained in an ON state, and the odd negative buffers L1, L3, L5 . . . Lm-1 and L1', L3', L5' . . . Lm-1' of the first and second negative buffer units 802 and 804 are maintained in an OFF state.

These result of these operations is that, as shown in FIG. 11A, the positive data processor 601 processes the positive analog data signals using the odd positive buffers H1, H3, H5 . . . Hm-1 and H1', H3', H5' . . . Hm-1' (shaded buffers) during the first frame period, and the negative data processor 602 processes the negative analog data signals using the even negative buffers L2, L4, L6 . . . Lm and L2', L4', L6' . . . Lm' (shaded buffers) during the first frame period.

These operations also have the result that, as shown in FIG. 11B, the positive data processor 601 processes the positive analog data signals using the even positive buffers H2, H4, H6 . . . Hm and H2', H4', H6' . . . Hm' (shaded buffers) during the second frame period, and the negative data processor 602 processes the negative analog data signals using the odd negative buffers L1, L3, L5 . . . Lm-1 and L1', L3', L5' . . . Lm-1' (shaded buffers) during the second frame period.

Accordingly, the positive analog data signals sampled by the odd positive sampling switches SS1, SS3, SS5 . . . SSm-1 are supplied to the odd positive buffers H1, H3, H5 . . . Hm-1, respectively.

The negative analog data signals sampled by the even positive sampling switches SS2, SS4, SS6 . . . SSm are supplied to the even positive buffers H2, H4, H6 . . . Hm, respectively.

The sampled positive analog data signals include: the first odd analog data signals Data_RO sampled by the (6k+1)-th positive sampling switches SS1, SS7, SS13 . . . SSm-5; the third odd analog data signals Data_BO sampled by the (6k+3)-th positive sampling switches SS3, SS9, SS15 . . . SSm-3; and the second even analog data signals Data_GE sampled by the (6k+5)-th positive sampling switches SS5, SS11, SS17 . . . SSm-1.

The sampled positive and negative analog data signals are supplied to the positive output controller 703 after being buffered by the positive buffers H1 to Hm included in the first positive buffer unit 702.

That is, the sampled positive analog data signals are supplied to the positive output controller 703 via the odd positive buffers H1, H3, H5 . . . Hm-1, whereas the sampled negative analog data signals are supplied to the positive output controller 703 via the even positive buffers H2, H4, H6 . . . Hm.

During this operation, the even positive buffers H2, H4, H6 . . . Hm are maintained in an OFF state. Accordingly, the sampled negative data signals supplied to the even positive buffers H2, H4, H6 . . . Hm are output as abnormal negative data signals.

The positive output switches OS1 to OSm included in the positive output controller 703 are simultaneously turned on in response to a line pass signal LPS which is supplied from the external of the positive output controller 703.

As a result, the sampled positive analog data signals stored in the positive buffers H1 to Hm and abnormal negative signals are simultaneously supplied to the second positive buffer unit 704 via the output switches OS1 to OSm.

That is, the sampled positive analog data signals are supplied to the second positive buffer unit 704 via the odd positive output switches OS1, OS3, OS5 . . . OSm-1. The abnormal negative signals are supplied to the second positive buffer unit 704 via the even positive output switches OS2, OS4, OS6 . . . OSm.

The odd positive buffers H1', H3', H5' . . . Hm-1' of the positive buffers H1' to Hm' included in the second positive buffer 704 buffer the sampled positive analog data signals, and supply the buffered signals to the selector 603. The even positive buffers H2', H4', H6' . . . Hm' supply the abnormal negative signals to the selector 603 without any signal processing.

Thus, the positive data processor 601 supplies m/2 sampled positive analog data signals and m/2 abnormal negative signals to the selector 603.

Next, operation of the negative data processor 602 carried out for the first frame period will be described.

As described above, during the first frame period, the even negative buffers L2, L4, L6 . . . Lm and L2', L4', L6' . . . Lm' of the first and second negative buffer units 802 and 804 are maintained in an ON state, and the odd negative buffers L1, L3, L5 . . . Lm-1 and L1', L3', L5' . . . Lm-1' of the first and second negative buffer units 802 and 804 are maintained in an OFF state.

Sampled negative analog data signals sampled by the even negative sampling switches SS2', SS4', SS6' . . . SSm' are supplied to the even negative buffers L2, L4, L6 . . . Lm, respectively.

Sampled negative analog data signals sampled by the odd negative sampling switches SS1', SS3', SS5' . . . SSm-1' are supplied to the odd negative buffers L1, L3, L5 . . . Lm-1, respectively.

The sampled negative analog data signals include: the second odd analog data signals Data_GO sampled by the (6k+2)-th negative sampling switches SS2', SS8', SS14' . . . SSm-4'; the first even analog data signals Data_RE sampled by the (6k+4)-th negative sampling switches SS4', SS10', SS16' . . . SSm-2'; and the third even analog data signals Data_BE sampled by the (6k+6)-th negative sampling switches SS6', SS12', SS18' . . . SSm'.

The sampled positive and negative analog data signals are supplied to the negative output controller 803 after being buffered by the negative buffers L1 to Lm included in the first negative buffer unit 802.

That is, the sampled negative analog data signals are supplied to the negative output controller 803 via the even negative buffers L2, L4, L6 . . . Lm, whereas the sampled positive analog data signals are supplied to the negative output controller 803 via the odd negative buffers L1, L3, L5 . . . Lm-1.

During this operation, the odd negative buffers L1, L3, L5 . . . Lm-1 are maintained in an OFF state. Accordingly, the sampled positive data signals supplied to the odd negative buffers L1, L3, L5 . . . Lm-1 are output as abnormal positive data signals.

The negative output switches OS1' to OSm' included in the negative output controller 803 are simultaneously turned on in response to the externally-supplied line pass signal LPS.

As a result, the sampled negative analog data signals stored in the negative buffers L1 to Lm and abnormal negative signals are simultaneously supplied to the second negative buffer unit 804 via the negative output switches OS1' to OSm'.

That is, the sampled negative analog data signals are supplied to the second negative buffer unit 804 via the even negative output switches OS2', OS4', OS6' . . . OSm'. The abnormal positive signals are supplied to the second negative buffer unit 804 via the odd negative output switches OS1', OS3', OS5' . . . OSm-1'.

The even negative buffers L2', L4', L6' . . . Lm' of the negative buffers L1' to Lm' included in the second negative buffer 804 buffer the sampled negative analog data signals, and supply the buffered signals to the selector 603. The odd negative buffers L1', L3', L5' . . . Lm-1' supply the abnormal positive signals to the selector 603 without any signal processing.

Thus, the negative data processor 602 supplies m/2 sampled negative analog data signals and m/2 abnormal positive signals to the selector 603.

The sampled positive analog data signals are supplied to the odd NMOS switches N1, N3, N5 . . . Nm-1, respectively, whereas the sampled negative analog data signals are supplied to the even NMOS switches N2, N4, N6 . . . Nm, respectively. The abnormal positive signals are supplied to the odd PMOS switches P1, P3, P5 . . . Pm-1, respectively, whereas the abnormal negative signals are supplied to the even PMOS switches P2, P4, P6 . . . Pm, respectively.

During the first frame period, the NMOS switches N1 to Nm of the selector 603 are turned on, whereas the PMOS switches P1 to Pm of the selector 603 are turned off. This is because the first control signal CS1 has a high logic voltage level during the first frame period.

Accordingly, the sampled positive analog data signals are supplied to the odd data lines DL1, DL3, DL5 . . . DLm-1 via the turned-on odd NMOS switches N1, N3, N5 . . . Nm-1, respectively. The sampled negative analog data signals are supplied to the even data lines DL2, DL4, DL6 . . . DLm via the turned-on even NMOS switches N2, N4, N6 . . . Nm, respectively.

In brief, the positive data processor 601 processes the positive analog data signals using the odd positive sampling switches SS1, SS3, SS5 . . . SSm-1 and the odd positive buffers H1, H3, H5 . . . Hm-1 and H1', H3', H5' . . . Hm-1' during the first frame period, and the negative data processor 602 processes the negative analog data signals using the even negative sampling switches SS2', SS4', SS6' . . . SSm' and the even negative buffers L2, L4, L6 . . . Lm and L2', L4', L6' . . . Lm' during the first frame period.

In this case, the first to m-th sampling scan pulses SP1 to SPm are sequentially output, to enable the analog data signals to be sequentially sampled. The sequentially-sampled analog data signals are the positive buffers H1 to Hm of the first positive buffer unit 702 and the negative buffers L1 to Lm of the first negative buffer unit 802, respectively.

That is, the first-sampled positive analog data signal is stored in the first positive and negative buffers H1 and L1. The secondly-sampled negative analog data signal is then stored in the second negative and positive buffers L2 and H2. The subsequently-sampled positive analog data signal is stored in the third positive and negative buffers H3 and L3. The subsequently-sampled negative analog data signal is stored in the fourth positive and negative buffers H4 and L4. In such a manner, the (m-1)-th sampled positive analog data signal is stored in the (m-1)-th positive and negative buffers Hm-1 and Lm-1. Finally, the finally-sampled negative analog data signal is stored in the m-th positive and negative buffers Hm and Lm.

Thereafter, the analog data signals stored in the positive buffers H1 to Hm and negative buffers L1 to Lm are simultaneously output to the selector 603 in response to the line pass signal LPS.

The pixel cells associated with one horizontal line of the display simultaneously receive sampled analog data signals in the above-described manner, to display an image. After the first frame period is ended after completion of operations associated with a plurality of horizontal periods corresponding to one frame period, a second frame period is begun.

During the second frame period, the first odd analog data signal Data_RO, third odd analog data signal Data_BO, and second even analog data signal Data_GE are maintained in a negative state, whereas the second odd analog data signal Data_GO, first even analog data signal Data_RE, and third even analog data signal Data_BE are maintained in a positive state.

During the second frame period, the first control signal CS1 has a low logic voltage level.

Accordingly, as shown in FIG. 11B, the odd negative sampling switches SS1', SS3', SS5' . . . SSm-1' sample the negative analog data signals, whereas the even positive sampling switches SS2, SS4, SS6 . . . SSm sample the positive analog data signals.

In addition, the even positive buffers H2, H4, H6 . . . Hm of the first positive buffer unit 702 and the even positive buffers H2', H4', H6' . . . Hm' of the second positive buffer unit 704 operate, whereas the odd positive buffers H1, H3, H5 . . . Hm-1 of the first positive buffer unit 702 and the odd positive buffers H1', H3', H5' . . . Hm-1' of the second positive buffer unit 704 do not operate.

The odd negative buffers L1, L3, L5 . . . Lm-1 of the first negative buffer unit 802 and the odd negative buffers L1', L3', L5' . . . Lm-1' of the second negative buffer unit 804 operate, whereas the even negative buffers L2, L4, L6 . . . Lm of the first negative buffer unit 802 and the even negative buffers L2', L4', L6' . . . Lm' of the second negative buffer unit 804 do not operate.

That is, during the second frame period, the positive data processor 601 processes positive analog data signals using the even positive sampling switches SS2, SS4, SS7 . . . SSm and the even positive buffers H2, H4, H6 . . . Hm and H2', H4', H6' . . . Hm'.

On the other hand, during the second frame period, the negative data processor 602 processes negative analog data signals using the odd negative sampling switches SS1', SS3', SS5' . . . SSm-1' and the odd negative buffers L1, L3, L5 . . . Lm-1 and L1', L3', L5' . . . Lm-1'.

In particular, the even positive buffers H2', H4', H6' . . . Hm' of the positive buffers H1' to Hm' included in the second positive buffer 704 buffer the sampled positive analog data signals, and supply the buffered signals to the selector 603. The odd positive buffers H1', H3', H5' . . . Hm-1' of the positive buffers H1' to Hm' supply the abnormal negative signals to the selector 603 without any signal processing.

Thus, the positive data processor 601 supplies m/2 sampled positive analog data signals and m/2 abnormal negative signals to the selector 603.

The odd negative buffers L1', L3', L5' . . . Lm-1' of the negative buffers L1' to Lm' included in the second negative buffer 804 buffer the sampled negative analog data signals, and supply the buffered signals to the selector 603. The even negative buffers L2', L4', L6' . . . Lm' supply the abnormal negative signals to the selector 603 without any signal processing.

Thus, the negative data processor 602 supplies m/2 sampled negative analog data signals and m/2 abnormal positive signals to the selector 603.

The sampled positive analog data signals are supplied to the even PMOS switches P2, P4, P6 . . . Pm, respectively. The sampled negative analog data signals are supplied to the odd PMOS switches P1, P3, P5 . . . Pm-1, respectively. The abnormal positive signals are supplied to the even NMOS switches N2, N4, N6 . . . Nm, respectively. The abnormal negative signals are supplied to the odd NMOS switches N1, N3, N5 . . . Nm-1, respectively.

As the first control signal CS1 has a low logic voltage level during the second frame period, the PMOS switches P1 to Pm of the selector 603 are turned on, and the NMOS switches N1 to Nm of the selector 603 are turned off.

As a result, the sampled positive analog data signals are supplied to the even data lines DL2, DL4, DL6 . . . DLm via the turned-on even PMOS switches P2, P4, P6 . . . Pm, respectively. On the other hand, the sampled negative analog data signals are supplied to the odd data lines DL1, DL3, DL5 . . . DLm-1 via the turned-on odd PMOS switches P1, P3, P5 . . . Pm-1, respectively.

Thus, all data lines DL1 to DLm have the same charge start time and the same charging period. In this embodiment, it is also possible to reduce the power consumption of the buffers because the buffers have different driving ranges, respectively.

FIG. 12A is a schematic diagram illustrating a polarity pattern of the display device in an odd frame period. During the first frame period as described above, the pixel cells of the display have a polarity pattern as shown in FIG. 12A (line inversion driving method).

FIG. 12B is a schematic diagram illustrating a polarity pattern of the display device in an even frame period. During the second frame period as described above, the pixel cells of the display have a polarity pattern as shown in FIG. 12B (line inversion driving method).

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A drive circuit of a display device comprising:

at least one data transfer line to receive analog data signals having information for an image;

a first positive latch to sequentially sample positive and negative analog data signals received by the at least one data transfer line and to sequentially store the sampled positive and negative analog data signals;

a second positive latch to simultaneously output the positive and negative analog data signals sampled by the first positive latch;

a first negative latch to sequentially sample the positive and negative analog data signals received by the at least one data transfer line and to sequentially store the sampled positive and negative analog data signals;

a second negative latch to simultaneously output the positive and negative analog data signals sampled by the first negative latch;

a selector to select the positive ones of the sampled positive and negative analog data signals output from the second positive latch and to select the negative ones of the sampled positive and negative analog data signals output from the second negative latch, and to simultaneously supply the selected positive and negative analog signals to a display; and a shift register, wherein the first positive latch comprises a positive sampler to sequentially sample the positive and negative analog data signals transferred from the at least one data transfer line, and a positive buffer unit to store and buffer the positive and negative analog data signals sampled by the positive sampler, wherein the first negative latch comprises a negative sampler to sequentially sample the positive and negative analog data signals transferred from the at least one data transfer line, and a negative buffer unit to store and buffer the positive and negative analog data signals sampled by the negative sampler, wherein the positive sampler comprises a plurality of positive sampling switches connected between the at least one data transfer line and the positive buffer unit, and adapted to sample the positive and negative analog data signals transferred from the at least one data transfer line in a sequential manner, respectively, wherein the negative sampler comprises a plurality of negative sampling switches connected between the at least one data transfer line and the negative buffer unit, and adapted to sample the positive and negative analog data signals transferred from the at least one data transfer line in a sequential manner, respectively, a shift register to sequentially supply sampling scan pulses to the positive sampling switches to sequentially turn on the positive sampling switches and to sequentially supply the sampling scan pulses to the negative sampling switches to sequentially turn on the negative sampling switches, wherein the second positive latch comprises a positive output controller to simultaneously output sampled positive and negative analog data signals stored in the first positive latch, and a positive buffer unit to buffer sampled positive and negative analog data signals output from the positive output controller, and to supply the buffered analog data signals to the display, wherein the second negative latch comprises a negative output controller to simultaneously output sampled positive and negative analog data signals stored in the first negative latch, and a negative buffer unit to buffer the sampled positive and negative analog data signals output from the negative output controller, and to supply the buffered analog data signals to the display, wherein the positive output controller comprises a plurality of positive output switches to simultaneously output sampled positive and negative analog data signals from the first positive latch, the positive output switches to be simultaneously turned on in response to an external control signal, wherein the negative output controller comprises a plurality of negative output switches to simultaneously output the sampled positive and negative analog data signals from the first negative latch, the negative output switches to be simultaneously turned on in response to the control signal, wherein the control signal is only synchronized with a sampling scan pulse to be supplied to a sampling switch that is turned on last among the plurality of the positive and negative sampling switches, wherein the positive buffer unit comprises a plurality of positive buffers each connected between an associated one of the data lines and the output controller, wherein the negative buffer unit comprises a plurality of negative buffers each connected between an associated one of the data lines and the output controller, wherein the positive buffers operate in a voltage range between minimum and maximum grayscale voltages of the positive analog data signals, and wherein the negative buffers operate in a voltage range between minimum and maximum grayscale voltages of the negative analog data signals.

2. The drive circuit according to claim 1, wherein the positive sampling switches each correspond to a respective negative sampling switches so that corresponding positive and negative sampling switches receive the same sampling scan pulse, and are simultaneously turned on by the received same sampling scan pulse.

3. The drive circuit according to claim 1, wherein the positive buffer unit comprises:

a plurality of positive buffers to store and buffer the sampled positive and negative analog data signals sequentially supplied from the positive sampler; and a plurality of negative buffers to storing and buffer the sampled positive and negative analog data signals sequentially supplied from the negative sampler.

4. The drive circuit according to claim 3, wherein:

odd and even ones of the positive buffers operate alternately on a frame period basis; and odd and even ones of the negative buffers operate alternately on a frame period basis.

5. The drive circuit according to claim 4, wherein:

the odd positive buffers operate in odd frame periods;

the even positive buffers operate in even frame periods;

the odd negative buffers operate in the even frame periods; and the even negative buffers operate in the odd frame periods.

6. The drive circuit according to claim 3, wherein respective positive buffers and the negative buffers operate in different voltage ranges.

7. The drive circuit according to claim 6, wherein:

the positive buffers operate in a voltage range between minimum and maximum grayscale voltages of the positive analog data signals; and the negative buffers operate in a voltage range between minimum and maximum grayscale voltages of the negative analog data signals.

8. The drive circuit according to claim 1, wherein:

the display comprises a plurality of gate lines and a plurality of data lines crossing the gate lines.

9. The drive circuit according to claim 8, wherein:

odd and even ones of the positive buffers operate alternately on a frame period basis; and odd and even ones of the negative buffers operate alternately on a frame period basis.

10. The drive circuit according to claim 9, wherein:

the odd positive buffers operate in odd frame periods;

the even positive buffers operate in even frame periods;

the odd negative buffers operate in the even frame periods; and the even negative buffers operate in the odd frame periods.

11. The drive circuit according to claim 8, wherein the positive buffers and the negative buffers operate in different voltage ranges.

12. The drive circuit according to claim 1, wherein the selector comprises:

a plurality of first switches to output sampled positive analog data signals sampled by the second positive latch, and interrupt negative analog data signals sampled by the second positive latch; and a plurality of second switches to output sampled negative analog data signals sampled by the second negative latch and to interrupt positive analog data signals sampled by the second negative latch.

13. The drive circuit according to claim 1, wherein:

the at least one data transfer line comprises first to sixth data transfer lines;

the first data transfer line is supplied with a first odd analog data signal having image information related to red;

the second data transfer line is supplied with a second odd analog data signal having image information related to green;

the third data transfer line is supplied with a third odd analog data signal having image information related to blue;

the fourth data transfer line is supplied with a first even analog data signal having image information related to red;

the fifth data transfer line is supplied with a second even analog data signal having image information related to green; and the sixth data transfer line is supplied with a third even analog data signal having image information related to blue.

14. The drive circuit according to claim 13, wherein each of the first to third even analog data signals and first to third odd analog data signals comprises a positive analog data signal and a negative analog data signal.

15. The drive circuit according to claim 14, wherein the analog data signals respectively supplied to adjacent ones of the first to sixth data transfer lines have opposite polarities.

* * * * *